US007171702B2

(12) United States Patent
Shaw

(10) Patent No.: US 7,171,702 B2
(45) Date of Patent: Feb. 6, 2007

(54) TOILET TANK FILL VALVE AND METHOD OF OPERATION

(75) Inventor: William S. Shaw, Austin, TX (US)

(73) Assignee: H2O Guard, Inc., Austin, TX (US)

( * ) Notice: Subject to any disclaimer, the term of this patent is extended or adjusted under 35 U.S.C. 154(b) by 0 days.

(21) Appl. No.: 10/676,544

(22) Filed: Oct. 1, 2003

(65) Prior Publication Data

US 2005/0071913 A1 Apr. 7, 2005

(51) Int. Cl.
*E03D 1/36* (2006.01)

(52) U.S. Cl. ..... 4/366

(58) Field of Classification Search ..... 4/366; 251/15, 48

See application file for complete search history.

(56) References Cited

U.S. PATENT DOCUMENTS 5,134,729 A 8/1992 Shaw ..... 4/415

6,088,846 A * 7/2000 Baron ..... 4/366 X

* cited by examiner

*Primary Examiner*—Robert M. Fetsuga
(74) *Attorney, Agent, or Firm*—Hulsey Intellectual Property Lawyers, P.C.

(57) ABSTRACT

A metered water control system inlet tube (24) receiving water conducting water into the interior of the tank to a diverter. A diverter (48) channels the flow to cause mechanical motion responsive to the channeled flow. A control valve (66 and 60), responsive to a mechanical switch, opens and closes access of the water from the inlet tube to the diverter. A mechanical switch (124, 112, and 114), responsive to flow of water from the diverter, closes the control valve automatically when a predeterminable volume of water flows through the diverter. A discharge tube (20 and 24) receives water from the diverter to discharge the water into the tank. An actuator (158 and 162) linked to a flush arm of the toilet and linked to the mechanical switch causes the switch to open the control valve to allow the pre-determined volume of water to flow into the discharge tube.

11 Claims, 26 Drawing Sheets

TOILET TANK FILL VALVE AND METHOD OF OPERATION

TECHNICAL FIELD OF THE INVENTION

The present invention relates to valves and the like for controlling the flow of water into a tank, such as a toilet, and more particularly to a metered water control system for flush toilet tanks.

BACKGROUND OF THE INVENTION

Toilets of the kind used in American homes, hotels and motels, are typically connected to the potable water supply. Each one uses approximately 1.5 to 4.5 gallons of water per flush. The majority of these toilets operate by means of a flotation device attached to a water flow valve. When the toilet is flushed, a chain connected to the flush handle lifts a flapper opening an outlet in the bottom of the toilet tank. The water from the tank flows into the toilet bowl raising the level of water therein. When the water in the toilet bowl exceeds the height of the bowl drain, water begins to flow from the bowl by a siphoning effect which suctions out all water and waste in the toilet bowl. During this period of time, the flotation device, floating on the water in the tank, drops as the tank water level drops. This, resultantly, opens a water inlet valve. When all water has exited the tank, the flapper falls closing the open outlet. The water now entering the tank, through the inlet valve, fills the tank. As the water level rises the float rises until the water valve is closed.

This system is effective, simple and relatively efficient. However, it can also be extremely wasteful. Should the flapper that closes the tank outlet wear, or become distorted, a leak occurs that allows water to constantly flow into the toilet bowl. If enough water escapes from the tank, the float drops opening the water inlet valve to replace the lost tank water. Conversely, the inlet valve is subject to distortion and/or the buildup of minerals, particularly in hard water areas, that interfere with its efficient operation to the point where it will never completely close. The same result may occur from improper adjustment of the flotation device. In these latter cases, there is a constant flow, however small, of water into the tank. To preclude flooding, an overflow tube in the tank exits the excess water into the toilet bowl. Thus, the level of water in the tank never exceeds the height of the overflow tube, given the current designs, as the amount of water that may be introduced into the tank at any given time is less than the amount of water that the overflow tube permits to escape. However, this continual flow also leads to a waste of water.

In addition, most ball cock-style toilets are made from porcelain cast mold. While, such a material is cost effective and long lasting for a traditional toilet. Unfortunately, in most of these toilets, metal bolts and washers secure the secure the bowl to the upper tank and at the floor. Over time, these bolts and washers corrode and rust, resulting in weakened contact points between the upper tank and the bowl. Soon, leaks occur at these weakened contacts, causing water damage outside of the toilet. This damage extends not only sub flooring and flooring materials, but also to woodwork, sheetrock, carpeting and nearby personal property.

Still further, damage to a porcelain tanks also often occurs due to faulty repairs by plumbers or maintenance personnel, as well as by users leaning against the tank. Such damage appears as stress cracks in the porcelain tank, which cracks oftentimes cannot be readily detected by resident or users. However, a shock of cold water in a tank can cause a stress fracture or stress crack to travel quickly, resulting in a catastrophic break. These types of catastrophic events can very quickly result in heavy insurance losses and claims. For example, in less than an hour of an undetected water flow from a toilet tank can flood a large residential areas and, in an apartment or condominium home, can even affect nearby residences. Claims of this type occur daily throughout the world, causing property insurance companies to pay annually billions in water damage claims. Today's ball cock- or float-type devices simply do not address these serious limitations.

The availability and conservation of water is a significant environmental concern. Changing weather patterns, increased agricultural needs, the cutting of woods and forests, and the increasing destruction of watersheds have reduced the quantity of fresh water available. These factors, combined with population growth, have created severe strains on the ability of both nature and man to supply the necessary potable water. It is not uncommon to hear about local water rationing during peak water use periods. The problem has become so severe in some areas that some legislatures have now enacted laws that require the use of toilets using less than the standard 3.5 gallons of water.

The toilet water conservation problem has been addressed, principally in the context of public toilets, that is, toilets in public facilities that normally do not have toilet tanks but rather have metered flush valves or other mechanical or electrical shut-off devices in the water line. However, a fluid operated valve for use with a toilet tank was disclosed in U.S. Pat. No. 1,145,791 issued to L. F. Pigott on Jul. 6, 1915. The patent disclosed a tank inlet valve assembly comprising an impeller screw seated in an inlet housing. The impeller is connected by a shaft to a screw, intermeshing with the screw is a second screw which is connected by a rod to a valve. The valve closes an outlet port. Attached to the second screw, at the side opposite the valve is a spring that is under tension when the valve is closed. The valve is activated by pulling a flush handle. The flush handle rotates an arm that supports the rod having the valve on one end and the screw with spring assembly on the other. This rotation disengages the two screws allowing the spring to retract, pulling the second screw, rod and valve assembly rearward to open the outlet port. When the flush handle is released, the rod is pulled back into position by a spring, remeshing the first and second screws. As the valve is opened, fluid exits through the outlet port thereby allowing water to enter through the inlet port, turning the impeller which in turn drives the first screw, now intermeshed with the second screw, until the valve is closed.

U.S. Pat. Nos. 1,552,261; 1,809,440 and 4,624,444, of Belcher, Elder and Johnson respectively, disclose metered flush valves that eliminate the need for a tank and are normally found in public facilities. The patent of Belcher, U.S. Pat. No. 1,552,261, discloses a metering device consisting of a valve that opens into the water flow and is closed by a combination of a spring pressure and water pressure. When the flush handle is turned, a mechanical linkage forces the valve open and locks it open by means of a ratchet. Water then flows through an impeller that is linked by a series of gears to a bar mechanism that is raised by the rotating impeller. The bar strikes the retaining ratchet tooth disengaging it and allowing the valve to close.

U.S. Pat. No. 1,809,440, of Elder, also discloses a valve for controlling the flow of water by turning off the water after a predetermined time or a given amount of water has passed. When the flush handle is rotated, paired inlet valves are opened to permit the water to flow. The flowing water strikes a turbine wheel. The turbine wheel is connected by a series of gears to a spiral gear that moves an arm to cause the rotation of the valves to a closed position. The patent of Johnson U.S. Pat. No. 4,624,444 is representative of shutoffs for flush toilets used in commercial establishments having pressurized lines.

Water control meters are also known for use in controlling watering devices. U.S. Pat. No. 4,280,530, of Yi, and U.S. Pat. No. 4,708,264, of Brunninga, are devices of this type. The device of Yi is placed in the water line for dispensing water to sprinklers or agricultural irrigation systems. Water enters through an inlet into an impeller chamber. The speed of rotation of the impeller is controlled by speed adjusting means which is essentially a frictional contact. The water flows from the impeller chamber into a second chamber containing the outlet valve. The outlet valve is set on one of three preset positions. Thus, the flowing water causes the impeller to rotate and an attached pinion gear initiates a gear train that terminates in a crescent gear. The crescent gear acts as a timing gear linked to the outlet valve and as it rotates, it slowly closes the valve to stop the flow of water.

U.S. Pat. No. 4,708,264, the device of Brunninga, also discloses a timed water meter for a hose or sprinkling system. The outlet valve is set to a predetermined open position and water flowing through the system rotates an impeller which is linked through a series of planetary gears to rotate the valve control assembly. The valve control assembly rotates until released, at which time it permits the valve to be closed.

An electronic water controller is disclosed in U.S. Pat. No. 4,633,905 of Wang. As water flows over a water wheel, magnetic sensors within the wheel cross a relay thereby inputting the flow rate into a microprocessor. On the basis of the flow rate and the amount of water to be dispensed, the microprocessor computes the time that the outlet valve should be open. The outlet valve is opened by rotating a cam which in turn raises a post attached to the outlet valve. The outlet valve remains open until the calculated flow time has been achieved at which time the motor rotates the cam to a point where the post is allowed to fall and the valve closed. The valve itself is forced into a closed position by a spring.

Another device for measuring a precise amount of water is that of Johns, U.S. Pat. No. 1,407,752. This is an in line measuring device that uses a combination of gearing and pressure differential associated with a piston to control the flow of water.

U.S. Pat. No. 4,335,852, of Chow, discloses another device for controlling the flow of fluid. The device consists of a flow inlet having a valve placed therein. The valve has an associated stem that is positioned to ride on a cam. The device is pre-set for a given amount of flow. When the water flow is initiated it flows by an impeller which is connected by means of intermeshing gears to an eccentric shaft that drives a pawl and ratchet, the ratchet being attached to the cam. The ratchet rotates the cam until such time as the stem can be pushed back into the stem notch. In addition to relying on water pressure to close the valve, a spring is placed between the ferrule cup, in the inlet, and a stud in the center of the valve assembly. The sealing means is an O-ring, around the valve, that is slightly larger than the opening for the inlet valve.

In U.S. Pat. No. 4,916,762 to Shaw, there is described a device for metering the flow of water into the tank and bowl of a toilet and providing a positive shut-off of the flow. When the toilet handle is turned, a linkage rotates a cam to force the stopper from its seat thereby commencing water flow. Water flows through a flow channel and past a water wheel imparting a rotation thereto. The water wheel is connected to the cam thereby rotating the cam. When the cam has rotated to position a notch over the stopper stem, the stopper is reseated by the pressure of the water and water flow ceases. The amount of water flow permitted is a function of the number of cam notches and flow nozzle size.

SUMMARY OF THE INVENTION

The present invention provides a method and system for metering water flow into the tank of a flush toilet and automatically disabling the flow of water when a predeterminable volume of water has flowed from an inlet tube that receives water from the water line.

According to the present invention, a metered water control system is provided to precisely control the amount of water used by a toilet, or water closet, during each flush cycle and to prevent further flow of water into the tank after the flush cycle has been completed. The invention limits the amount of water that flows into the tank per flush cycle to any predeterminable amount, which is typically in the range of from 1.5 to 4.5 gallons.

The method of the present invention provides for water received by an inlet tube from a water source to be conducted above the water line of the tank to be channeled by a diverter to cause mechanical motion of a metering assembly comprising a control valve to enable and disable flow of water from the inlet tube. The valve is controlled by a mechanical switch responsive to the mechanical motion of the metering assembly to automatically close the inlet tube when a pre-determined volume of water has flowed through the diverter. The mechanical switch is linked through an actuator to the flush arm of the toilet, so that when the toilet is flushed the flush cycle is initiated to allow the pre-determined volume of water to be discharged into the tank.

Once the pre-determined volume of water has been discharged, the flush cycle is complete and no more water can flow into the tank, regardless of the position of the flush arm or actuator, until the toilet is flushed again. Moreover, even if the flapper valve through which water enters the toilet bowl from the tank leaks or remains open, and even if the tank itself leaks, only the predetermined volume of water is discharged into the tank during a flush cycle.

The foregoing has outlined rather broadly aspects, features and technical advantages of the present invention in order that the detailed description of the invention that follows may be better understood. Additional aspects, features and advantages of the invention will be described hereinafter. It should be appreciated by those skilled in the art that the disclosure provided herein may be readily utilized as a basis for modifying or designing other structures for carrying out the same purposes of the present invention. Persons of skill in the art will realize that such equivalent constructions do not depart from the spirit and scope of the invention as set forth in the appended claims, and that not all objects attainable by the present invention need be attained in each and every embodiment that falls within the scope of the appended claims.

The present invention only engages once is the event of a leak. This results only in a loss of water from the tank and 1.6 to 4.5 gallon from an engagement of the handle during a breakage event to the tank. In an optimal operation, the present invention does not engage from a breakage event, causing only loss of the water then standing in the tank. This causes the present invention to prevent catastrophic water leakage and prevents or substantially eliminates the more severe types of water damage that conventional toilet mechanisms may allow. The present invention, therefore, prohibits a continuous flow of water that may occur with a ball cock or float device.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
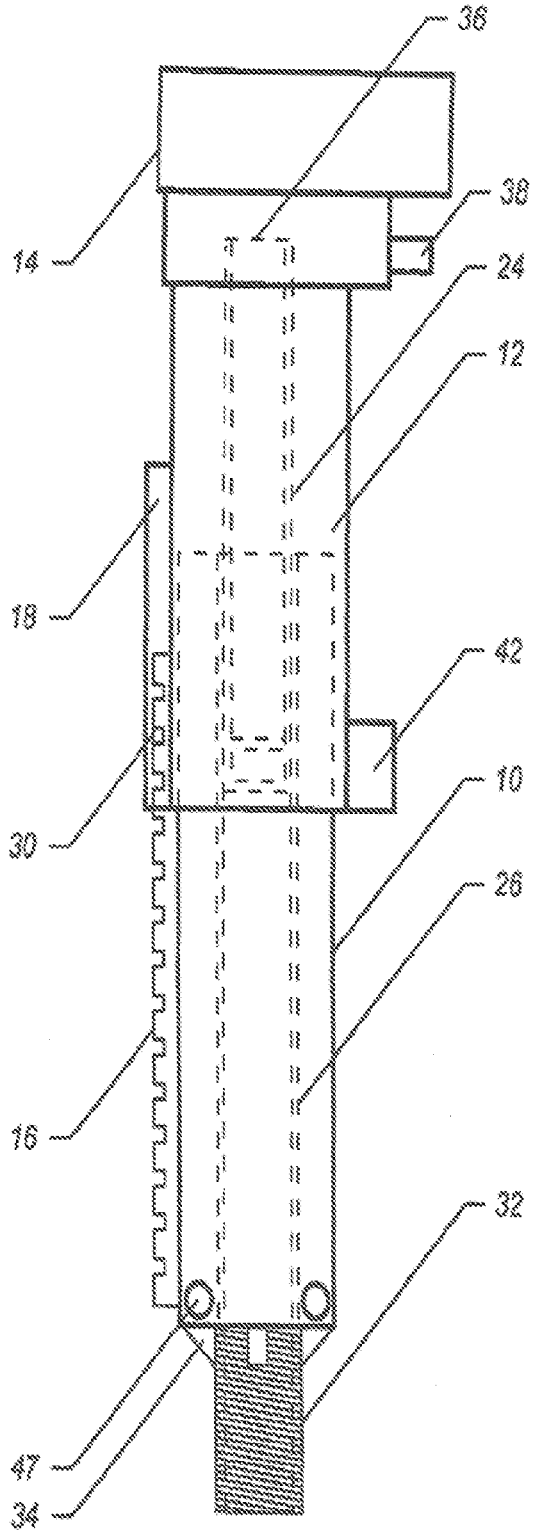
FIG. 1 shows assembly of the upper and lower body of a preferred embodiment of the present invention.
Figure 2:
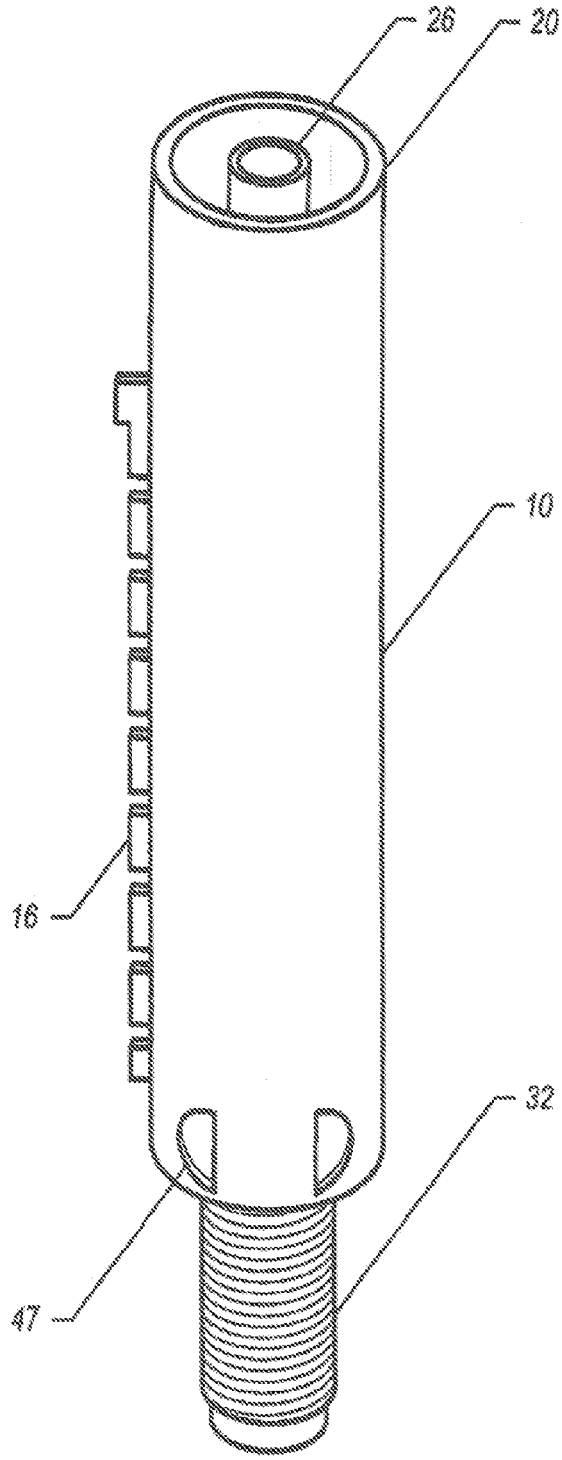
FIG. 2 is a perspective view of the lower body of a preferred embodiment of the present invention.
Figure 3:
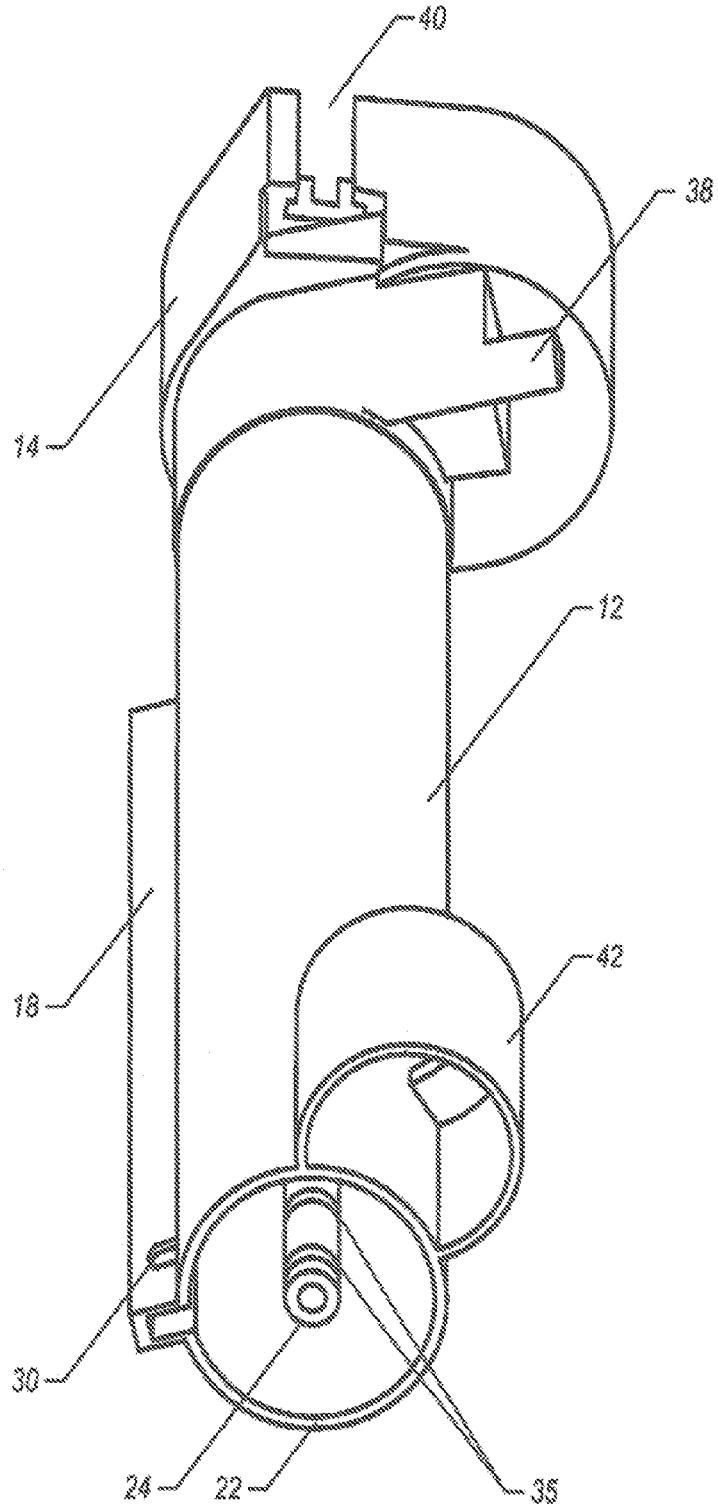
FIG. 3 is a perspective view of the upper body of a preferred embodiment of the present invention.

An assembly of a preferred embodiment of the present invention is shown in part in FIG. 1, comprising a lower body 10 and an upper body 12. At the uppermost portion of upper body 12 is a meter assembly housing 14. Perspective views of lower body 10 and upper body 12 are shown in FIGS. 2 and 3 respectively, where like parts are like-numbered.

As can be seen, lower body 10 comprises ridges 16 that insert into a slot of a ridge cavity 18 of upper body 12. When lower body 10 is inserted into upper body 12, an outer shell 20 of lower body 10 fits snugly interior to an outer shell 22 of upper body 12. Further, an inlet tube 24 of upper body 12 inserts snugly interior to an inlet tube 26 of lower body 10. Two O-rings 35 are positioned in separate grooves on the exterior of inlet tube 24 of upper body 12 to prevent water leakage between the exterior of inlet tube 24 and the interior of inlet tube 26.

Lower body 10 extends into upper body 12 and is fixed into place by inserting a pin into a hole 30 extending through ridge cavity 18 through a gap between ridges 16. This enables a meter assembly within assembly housing 14 to be positioned above the water line when the tank is filled, as is sometimes required by plumbing codes.

Lower body 10 comprises a threaded end 32 that is connected to the inlet fitting on the bottom of the toilet tank in the conventional manner. The inlet fitting receives water from a water line supplied by a cold water pipe of a conventional indoor plumbing system. A gasket 34 is provided to prevent leakage and to secure the assembly of FIG. 1 in a vertical upright position.

Water flows into tube 26 from the water line through threaded end 32 and is conducted by pressure up through inlet tube 26 and inlet tube 24 to an upper end 36 of tube 24. Thus, the water supply is conducted to assembly housing 14 that is positioned such that inlet tube 26 and inlet tube 24 form an inlet tube that conducts water received from the water line to a level above the water line of the tank.

FIG. 3 also shows an overflow outlet 38, control housing retaining slot 40 and actuator housing 42. Overflow outlet 38 simply allows for overflow to be conducted to an overflow tube in the event of overflow as required by plumbing codes. Control housing retaining slot 40 and actuator housing 42 will both be discussed below in conjunction with the assembly and operation of a preferred embodiment of the invention.

Figure 4:
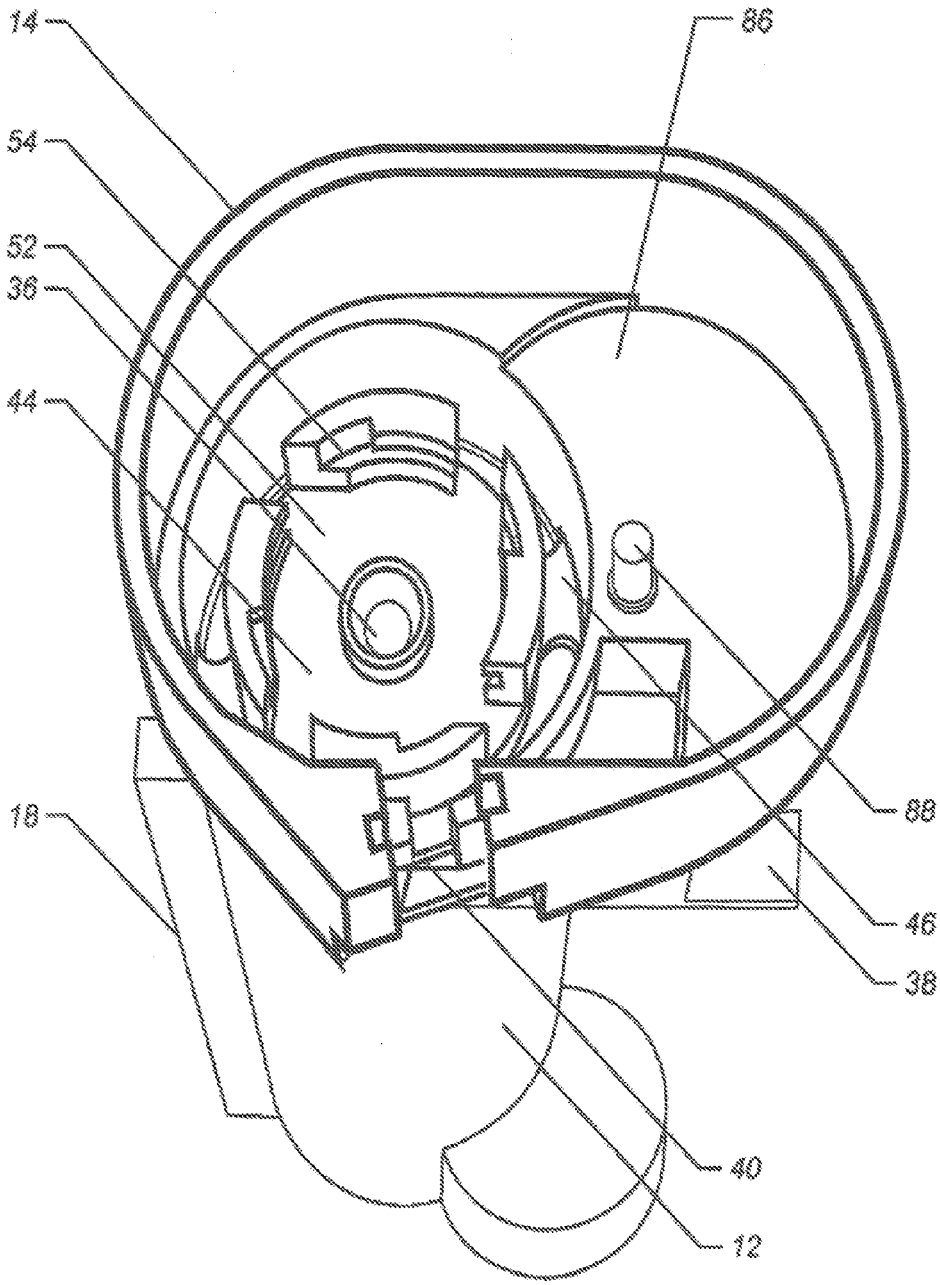
FIG. 4 is a top perspective view of the upper body of FIG. 3, showing the interior of an assembly housing of a preferred embodiment.

Shown in FIG. 4 is a top-perspective view of upper body 12, showing the interior of assembly housing 14. A water diversion fixture 44 can be seen at the upper end 36 of inlet tube 24, which is preferably integrally molded to diversion fixture 44. Water diversion fixture 44 is attached and mounted to the interior wall of outer shell 22 by mounts 46 which are uniformly positioned around the circumference of the interior wall of outer shell 22.

The outer diameter of diversion fixture 44 is sufficiently less than the interior diameter of outer shell 22 to enable water that passes upward and out of upper end 36 of inlet tube 24 to freely flow downward there between and exit from the lower end of lower body 12 through outlet holes 47 distributed about the periphery of outer shell 20. Thus, exterior shells 20 and 22 form a discharge tube that discharges water received from the diverter into the tank.

Figure 5:
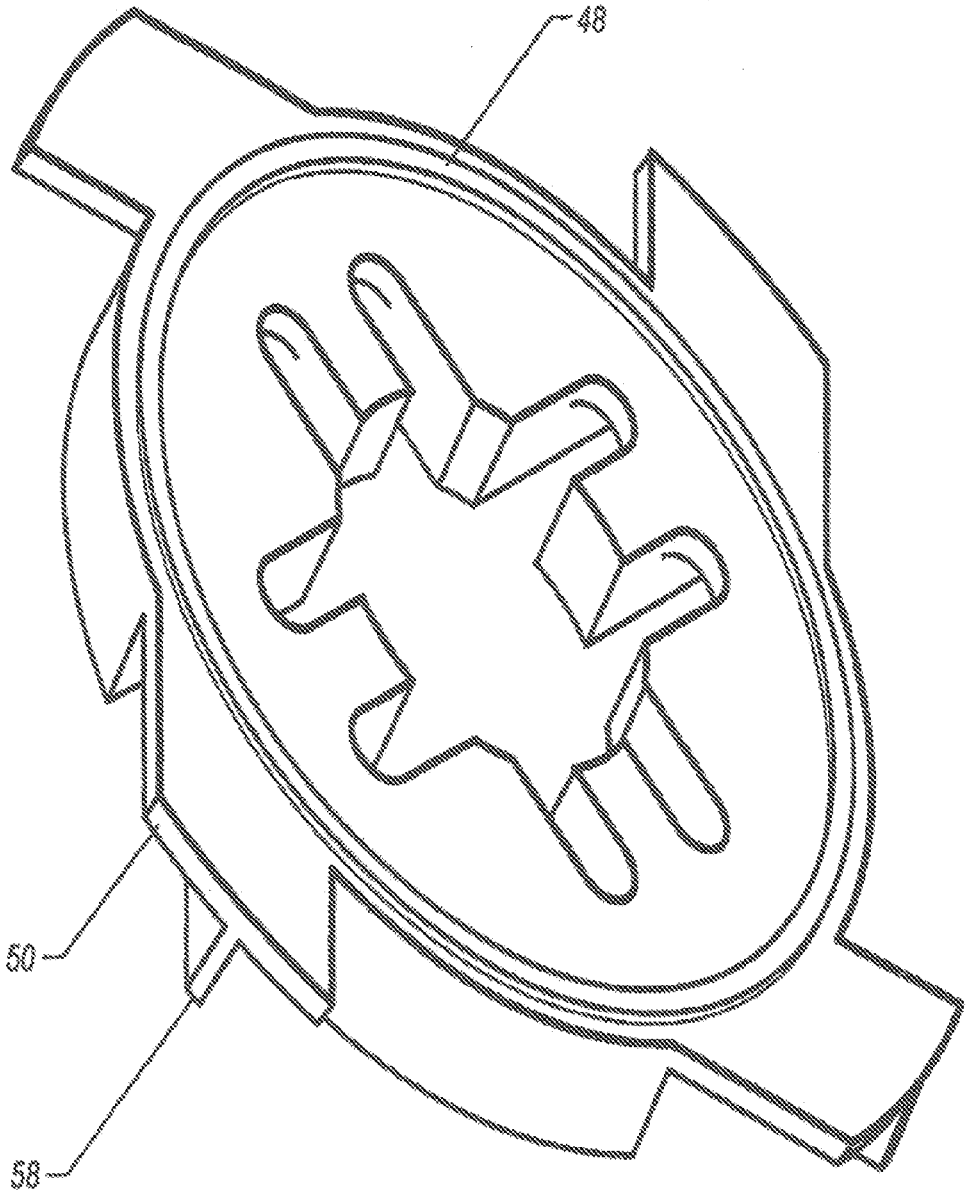
FIG. 5 is a top perspective view of a diverter.
Figure 6:
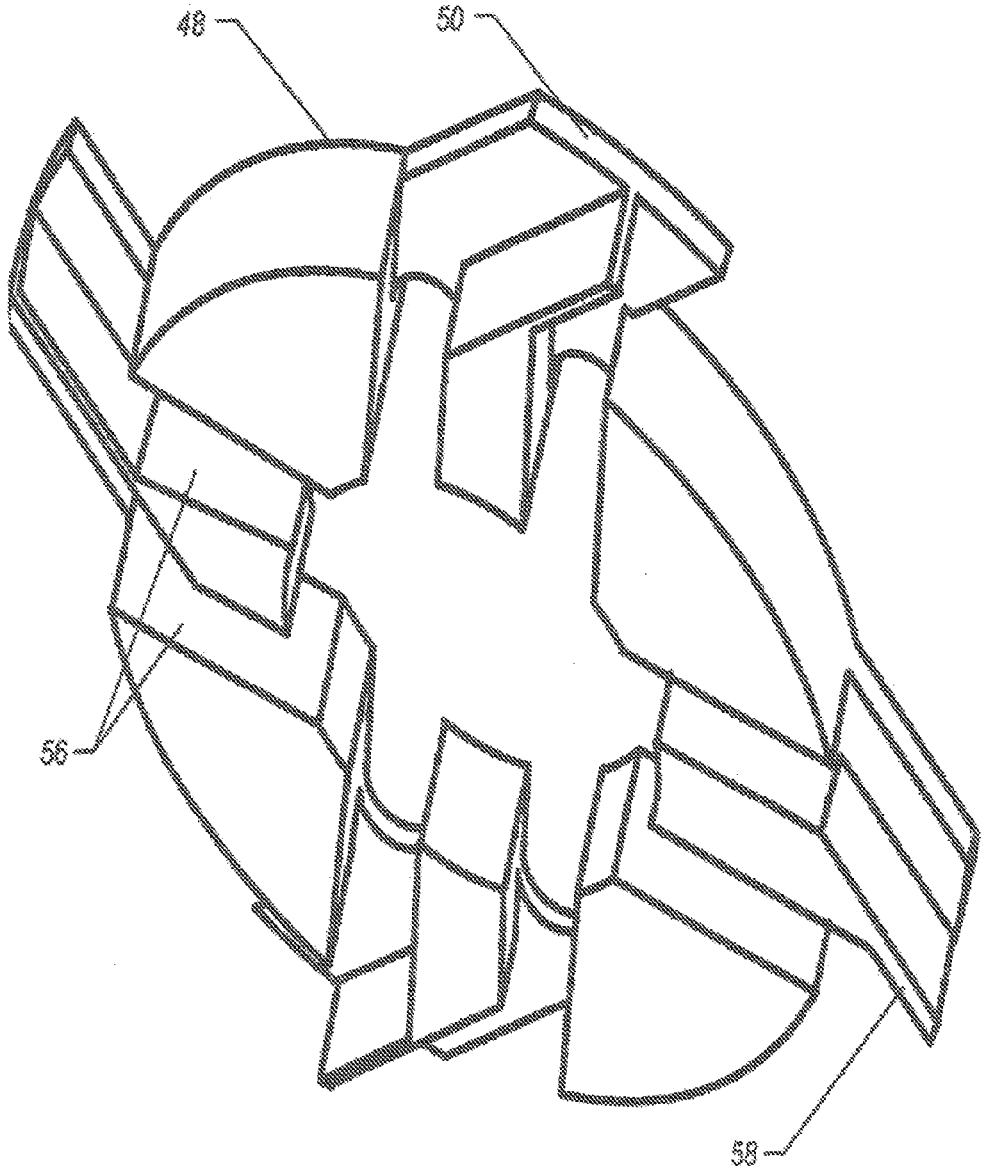
FIG. 6 is a bottom perspective view of the diverter shown in FIG. 5.

Removably insertable into diversion fixture 44 is a diverter 48 as shown in top perspective view in FIG. 5. Fins 50 of diverter 48 snugly insert in gaps 52 between grooved ridges 54 of diversion fixture 44. A bottom perspective view of diverter 48 is shown in FIG. 6. In an open-valve condition, as will be described in detail below, channels 56 will channel water rising up from inlet tube 24, so that water flows along vertical walls 58 of each fin 50.

Figure 7:
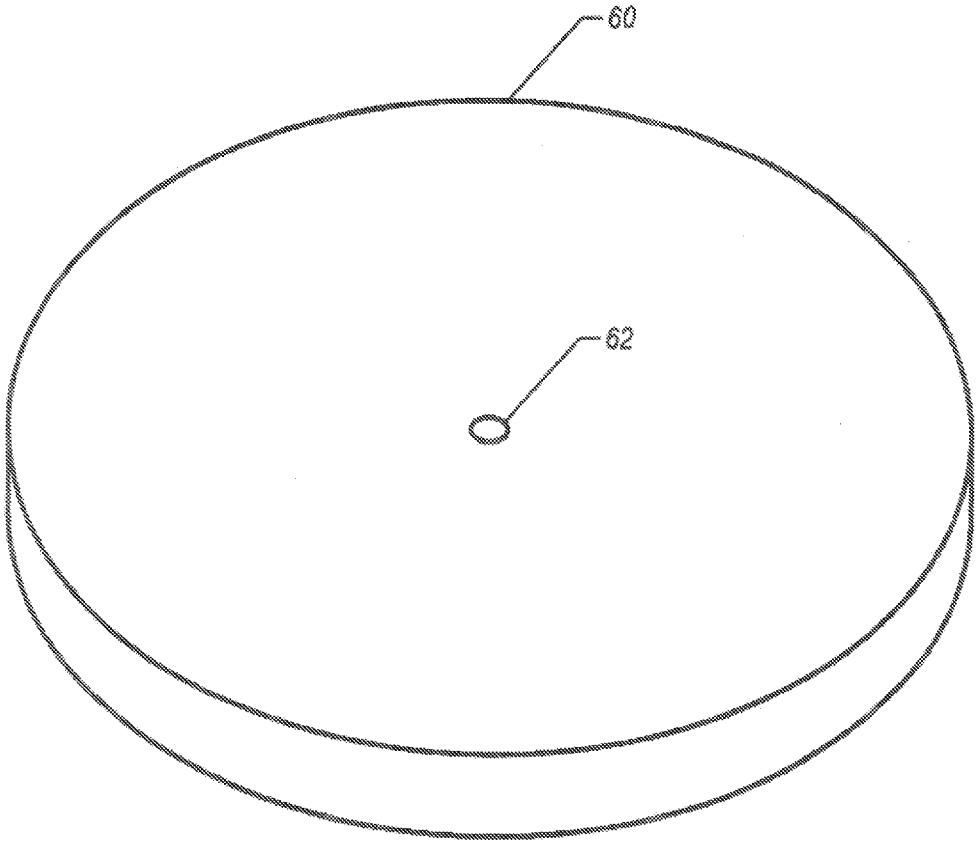
FIG. 7 is a perspective view of a diaphragm.

Removably insertable above diverter 48 is a thin diaphragm 60, which has a small hole 62 in its center, as shown in FIG. 7. Diaphragm 60 will, in a closed-valve condition, seal off end 36 of tube 24 and prevent water from flowing through channels 56.

Figure 8:
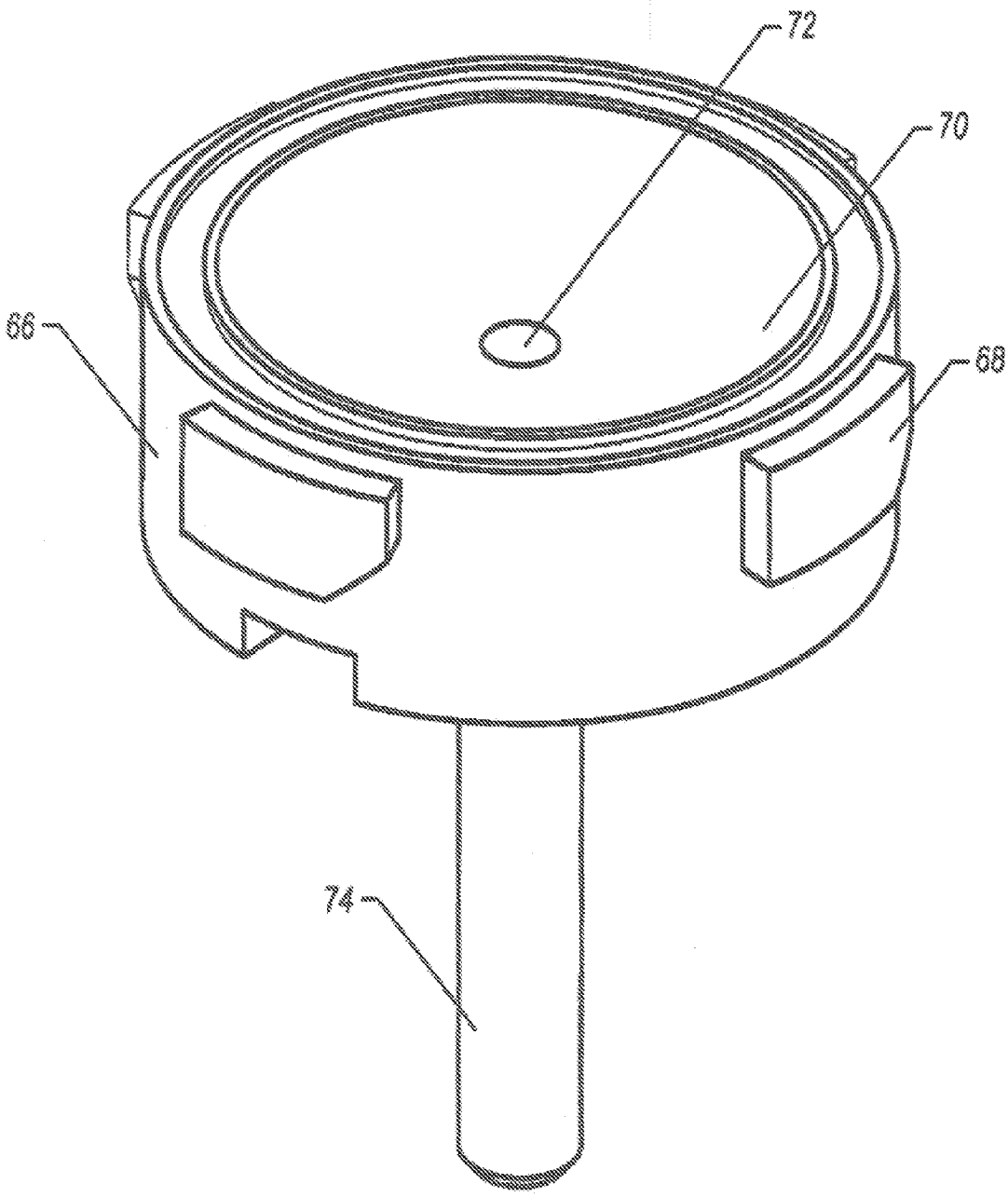
FIG. 8 is a bottom perspective view of a cone.
Figure 9:
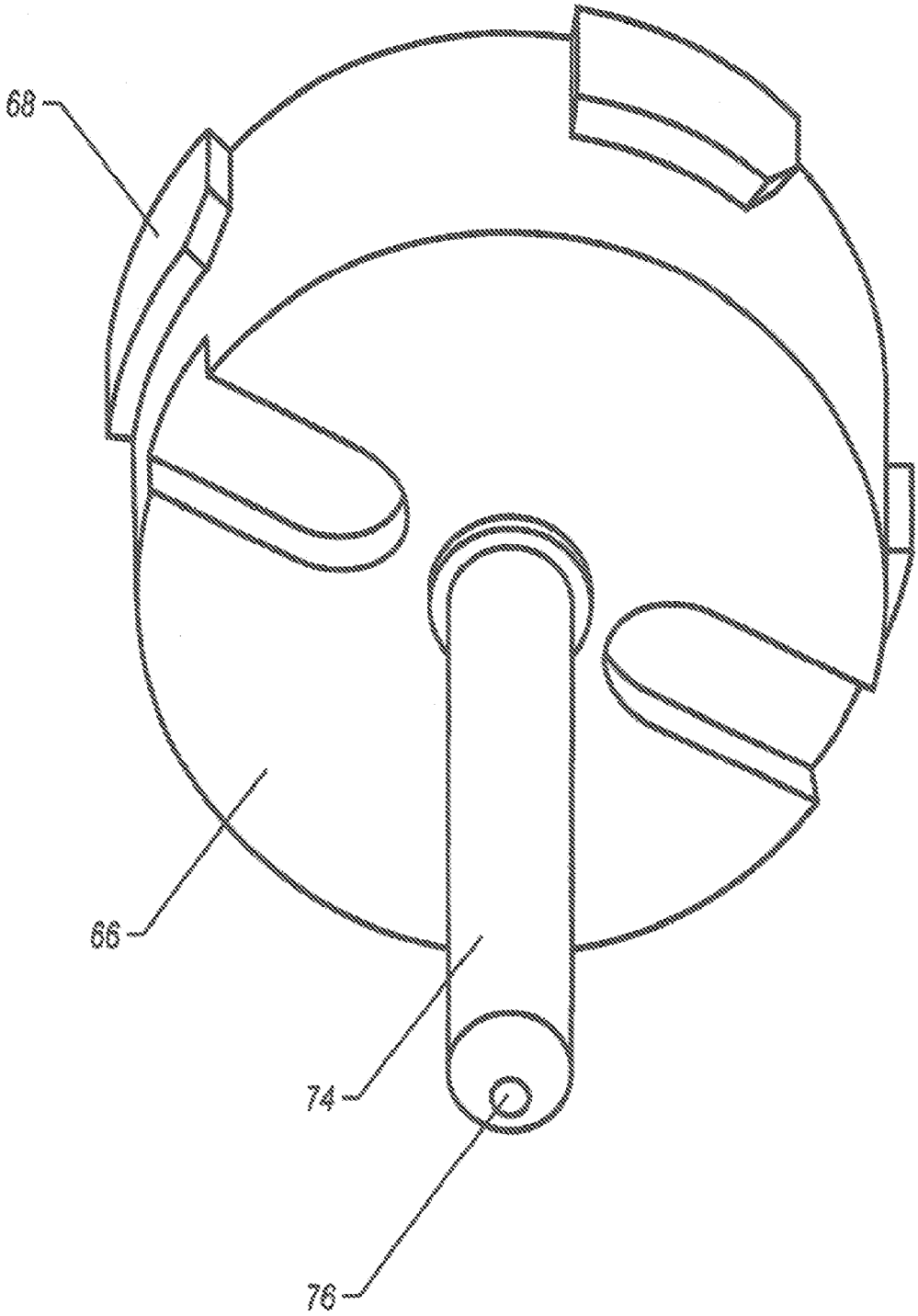
FIG. 9 is a top perspective view of the cone shown in FIG. 8.

Removably insertable above diaphragm 60 is a cone 66, shown in FIG. 8, with ridges 68 that cooperatively mate with grooved ridges 54 of diverter 48. In the center of the concave bottom surface 70 of cone 66 is a small hole 72 that conducts water upward through an upward-extending tube 74 of cone 66 when in an open valve condition. A top perspective view of cone 66 is shown in FIG. 9. As can be seen, a hole 76 in the top of tube 74 allows water to flow out of tube 74 when in an open-valve condition.

Figure 10:
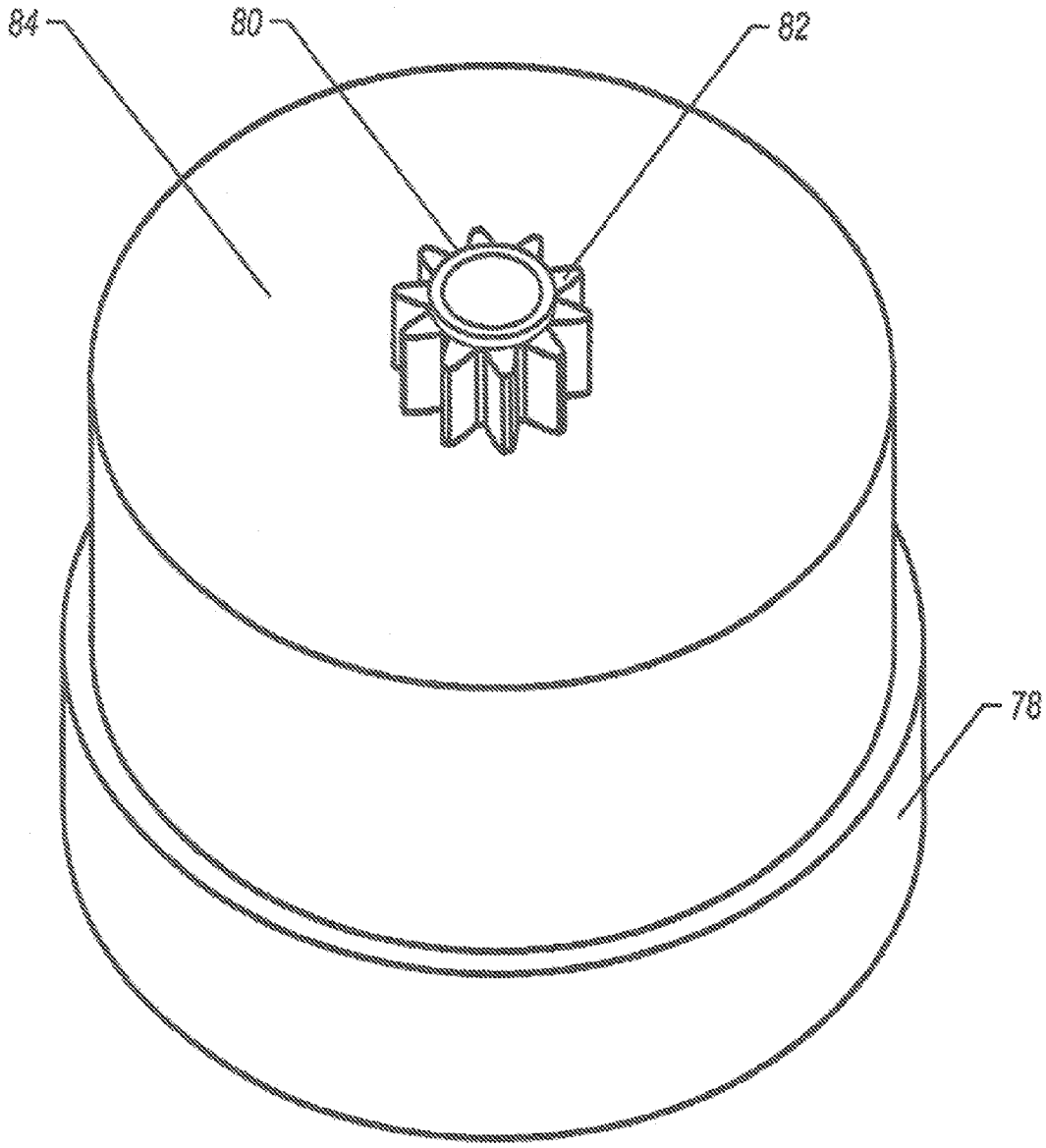
FIG. 10 is a top perspective view of a water wheel.
Figure 11:
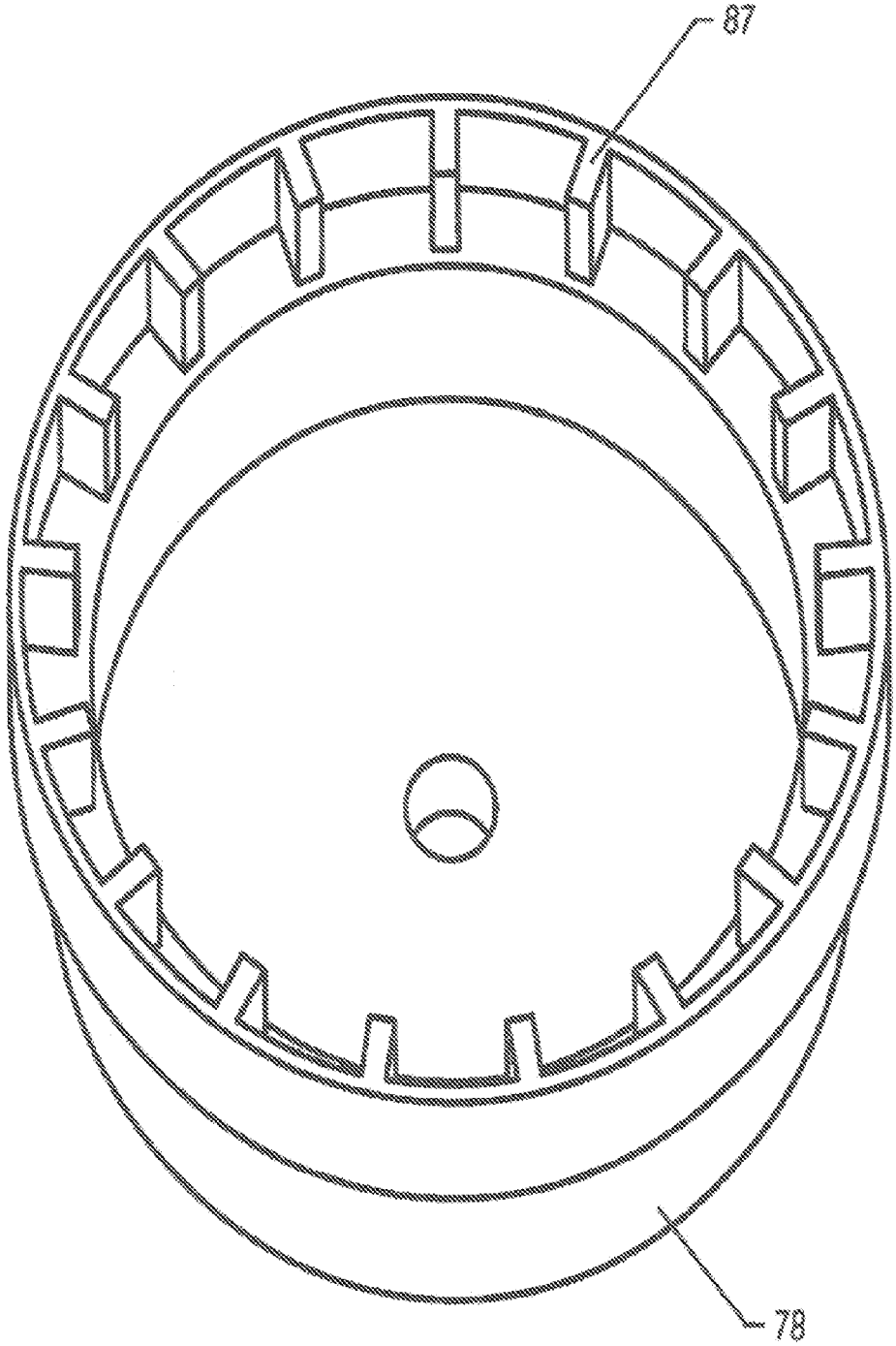
FIG. 11 is a bottom perspective view of the water wheel shown in FIG. 10.

Shown in FIG. 10 is a top perspective view of a water wheel 78. Wheel 78 is removably insertable over cone 66 so that the upward-extending portion of tube 74 of cone 66 extends through a center hole 80 of wheel 78. Shown in FIG. 11 is a bottom perspective view of water wheel 78. As can be seen, wheel 78 comprises interior fins 87. In an open valve condition, water flowing through channels 56, as channeled by vertical walls 58 of fins 50, will strike fins 87 of wheel 78 at about a 30-degree angle. This causes water wheel 78 to rotate about an axis passing through the axial center of tube 74 of cone 66. This in turn causes concentric rotation of the small gear 82 integrally formed on the upper surface of wheel 78. Thus, diverter 48 channels the flow of water received from the inlet tube formed by inlet tubes 24 and 26 to cause mechanical motion responsive to the channeled flow.

Figure 12:
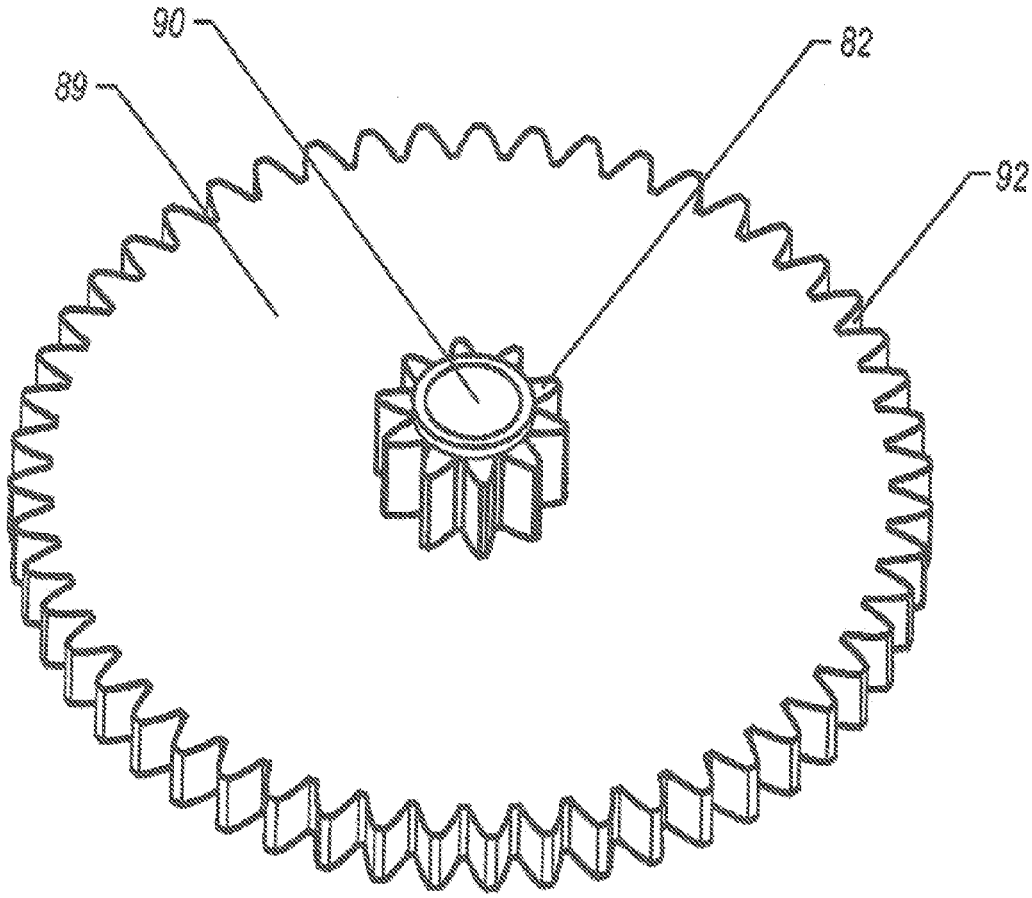
FIG. 12 is a top perspective view of a gear in a gear assembly of a preferred embodiment.

The upper surface 84 of wheel 78 is approximately flush with a horizontal surface 86 of assembly housing 14 shown in FIG. 4. Removably insertable onto a gear post 88 is a gear 89, shown in perspective view in FIG. 12, such that gear post 88 extends through a center hole 90 of gear 89, and such that teeth 92 of gear 89 mesh with the teeth of small gear 82 on the upper surface of wheel 78. Thus, when water causes rotation of small gear 82 of wheel 78, rotation of gear 89 about a vertical axis passing through the axial center of gear post 88 will occur.

Figure 13:
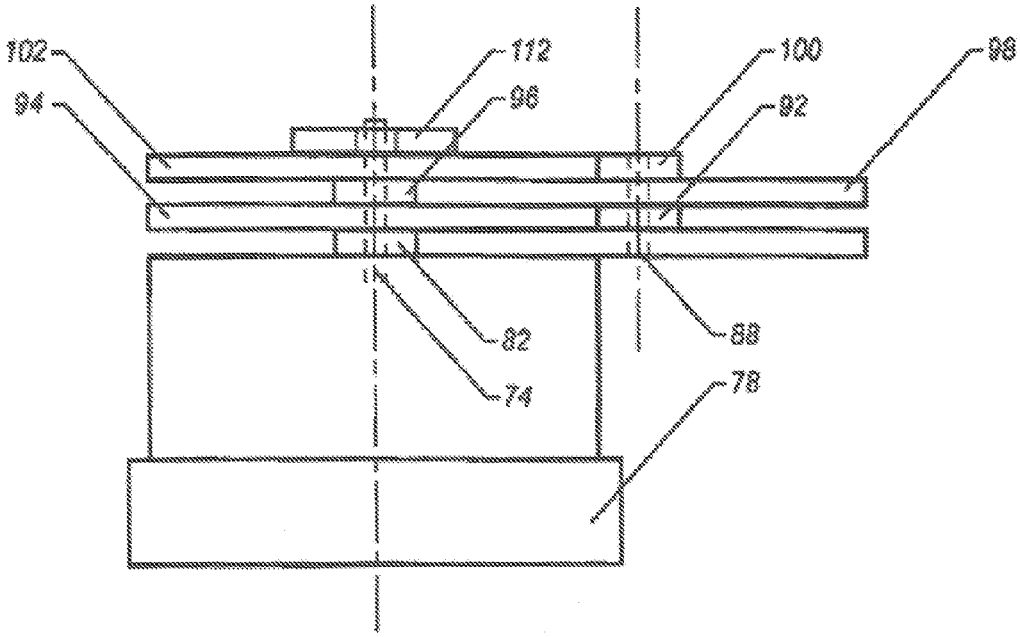
FIG. 13 illustrates the gear assembly of a preferred embodiment.

Shown in FIG. 13 is a simplified illustration of the gear assembly of the present invention for metering the flow of water into a toilet. As described above, water wheel 78 inserts onto tube 74 of cone 66 (not shown in FIG. 13) and gear 89 inserts onto gear post 88 so that its teeth mesh with small gear 82 of wheel 78. Integrally molded onto gear 89 is a small gear 82 that rotates concentrically with gear 89.

Inserted onto the upward extending portion of tube 74 of cone 66 is another gear 94, essentially identical in size and form to gear 89, such that tube 74 extends through a center hole in gear 94, and such that the outer teeth of gear 94 mesh with the small inner gear 92 of gear 89. Thus, when water causes rotation of gear 89, rotation of gear 94 about a vertical axis passing through the axial center of tube 74 will occur. Integrally molded onto gear 94 is a small inner gear 96 that rotates concentrically with gear 94.

Another gear 98, essentially identical in size and form to gears 89 and 94, inserts onto gear post 88 such that its outer teeth mesh with inner gear 96 of gear 94. Thus, gear 98 is caused by the rotation of gear 96 to rotate about the vertical axis passing through the axial center of gear post 88. Integrally molded onto gear 98 is a small inner gear 100 that rotates concentrically with gear 98.

Figure 14:
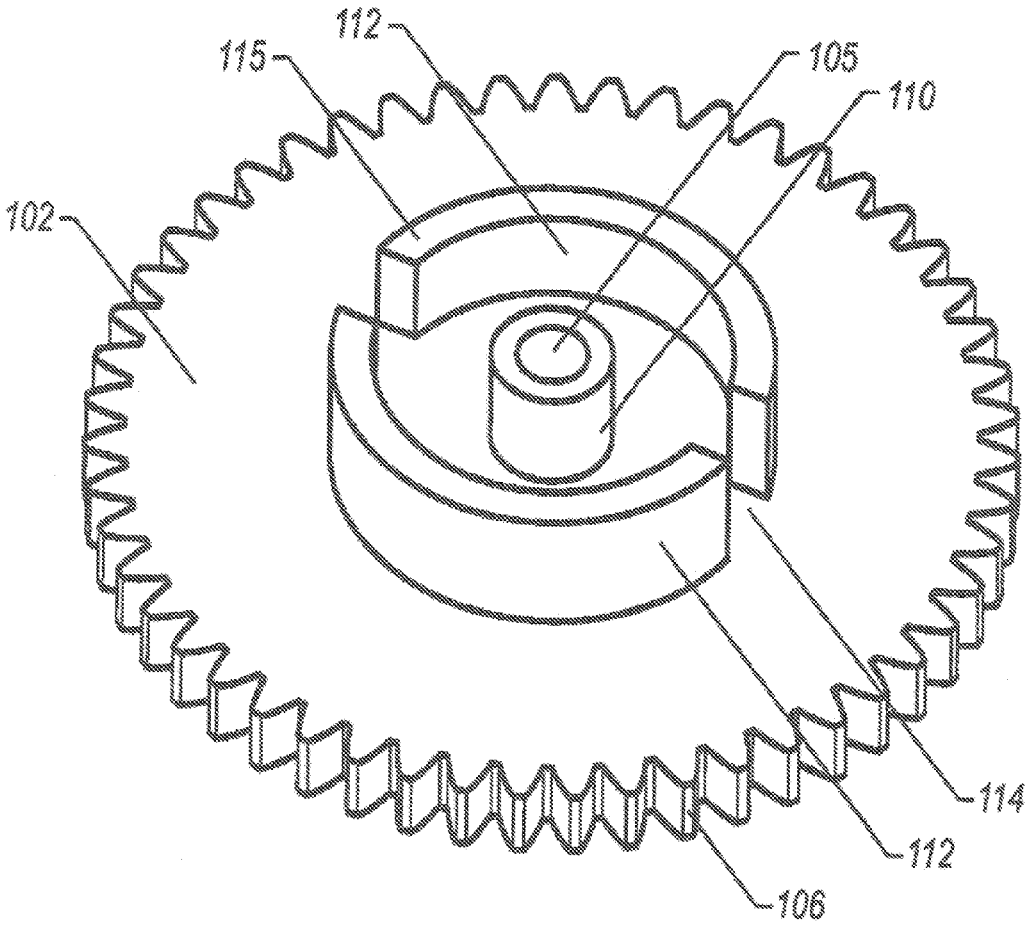
FIG. 14 illustrates a top gear employed in the gear assembly illustrated in FIG. 13.

Finally, a top gear 102, shown separately in FIG. 14, inserts onto tube 74 such that its outer teeth 106 mesh with the teeth of small inner gear 100. Thus, top gear 102 is caused by the rotation of gear 100 to rotate about the vertical axis passing through the axial center of tube 74. Note that top gear 102 further comprises a cylindrical protrusion 110. When the gear assembly of the present invention is assembled, tube 74 of cone 66 extends slightly above protrusion 110 so that a seal arm, to be discussed below, can seal and prevent water flow out of the top end 74 of cone 66 in a closed valve condition. Also note that top gear 102 comprises a set of semi-circular vertical ridges 112 integrally molded onto top gear 102 and separated by gaps 114. As will be explained in more detail below, semi-circular ridges 112 form a portion of a control mechanism for sealing and unsealing tube 74.

In a closed valve position no water flows out of the top end 36 of inner tube 24 and, consequently, wheel 78 is not caused to rotate. In an open valve condition, water flows from the top end 36 of inner tube 24 and is channeled by diverter 48 into a set of equally spaced streams around the periphery of diverter 48, thereby striking fins 87 of water wheel 78 and causing wheel 78 to rotate. Rotation of wheel 78 causes rotation of top gear 102 by way of the intermediate gears lying there between.

Figure 15:
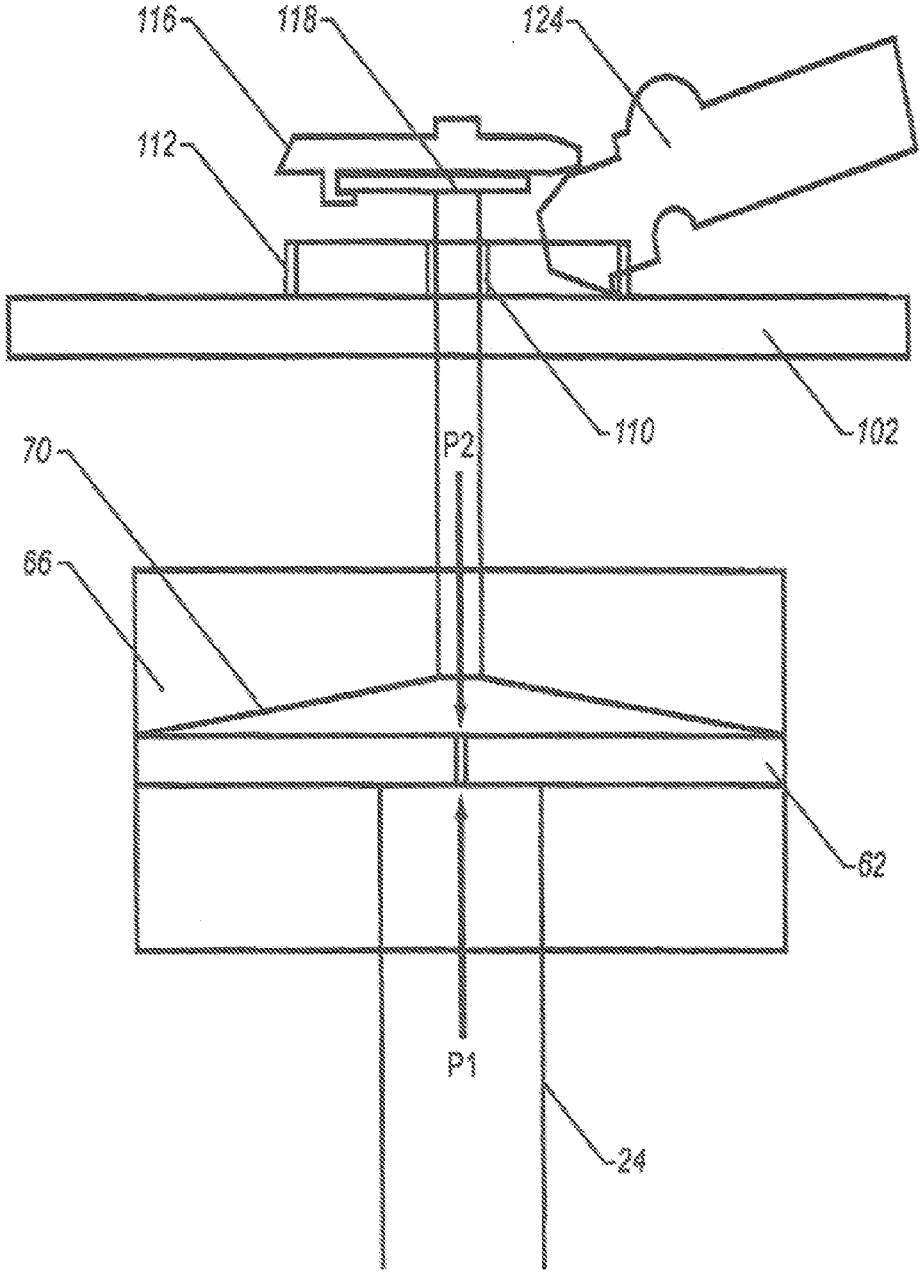
FIG. 15 illustrates a valve assembly in a closed valve condition.
Figure 16:
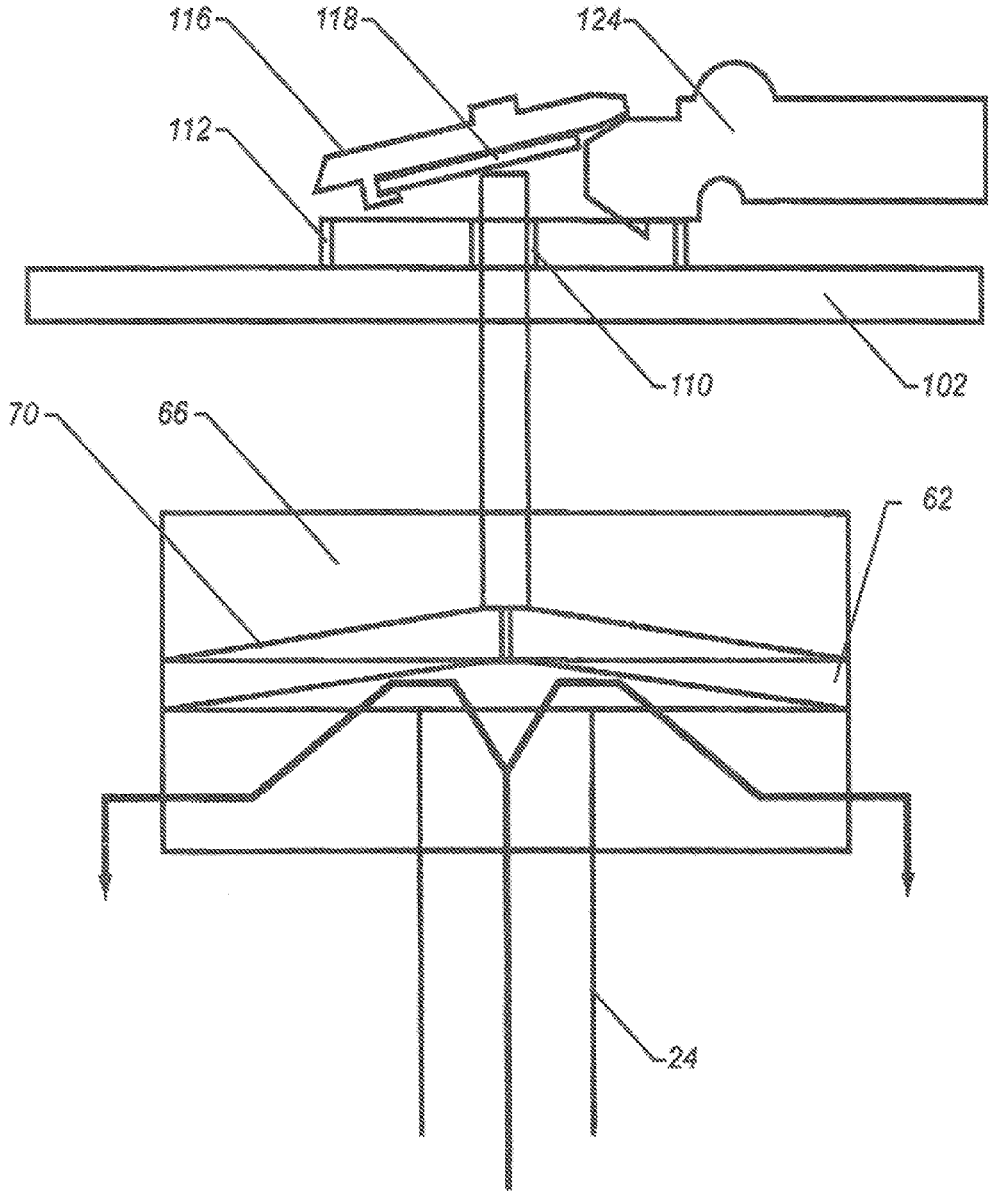
FIG. 16 illustrates the valve assembly in the open valve condition.

FIGS. 15 and 16 functionally illustrate the operation of the valve assembly of the present invention. In the closed position shown in FIG. 15, a seal arm 116 under which an elastomer 118 is fitted is forced downward by a spring (not shown) to cause the elastomer 118 to seal the hole 76 at the top end of tube 74, which extends through hole 105 slightly above the cylindrical protrusion portion 110 of top gear 102.

Figure 17:
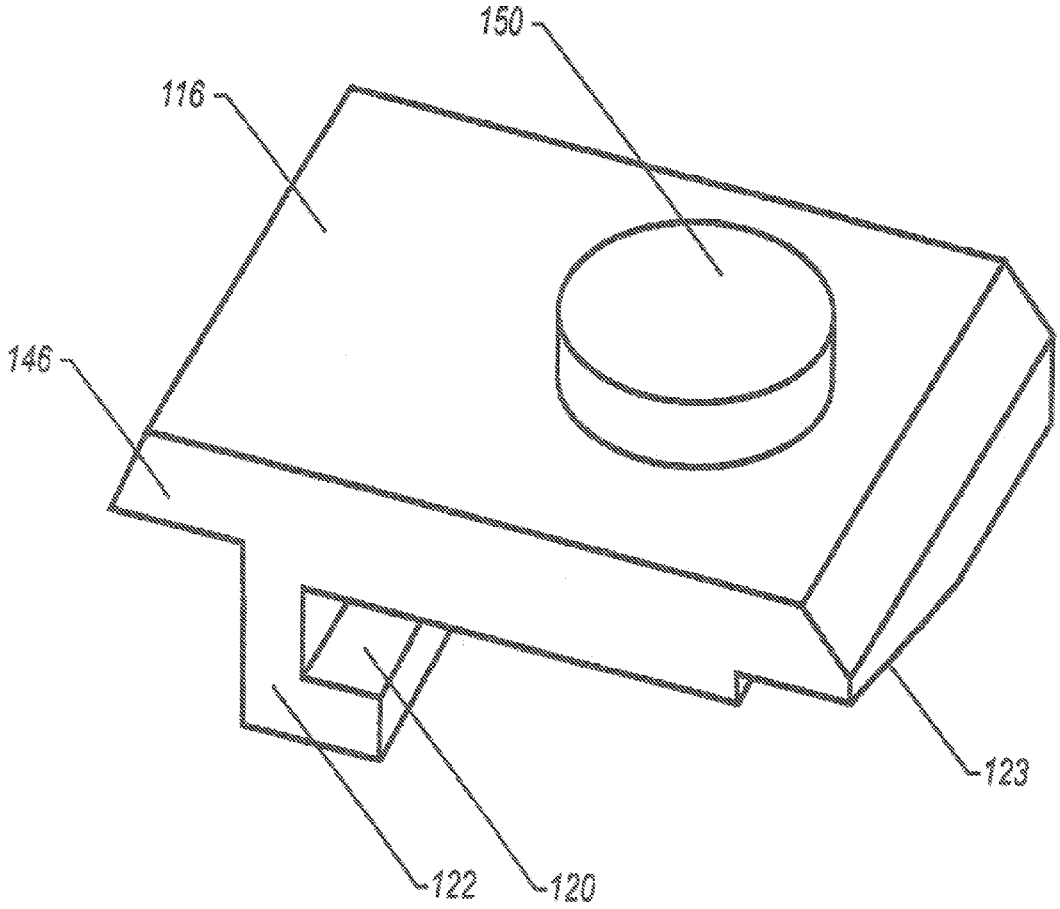
FIG. 17 is a top perspective view of a seal arm.
Figure 18:
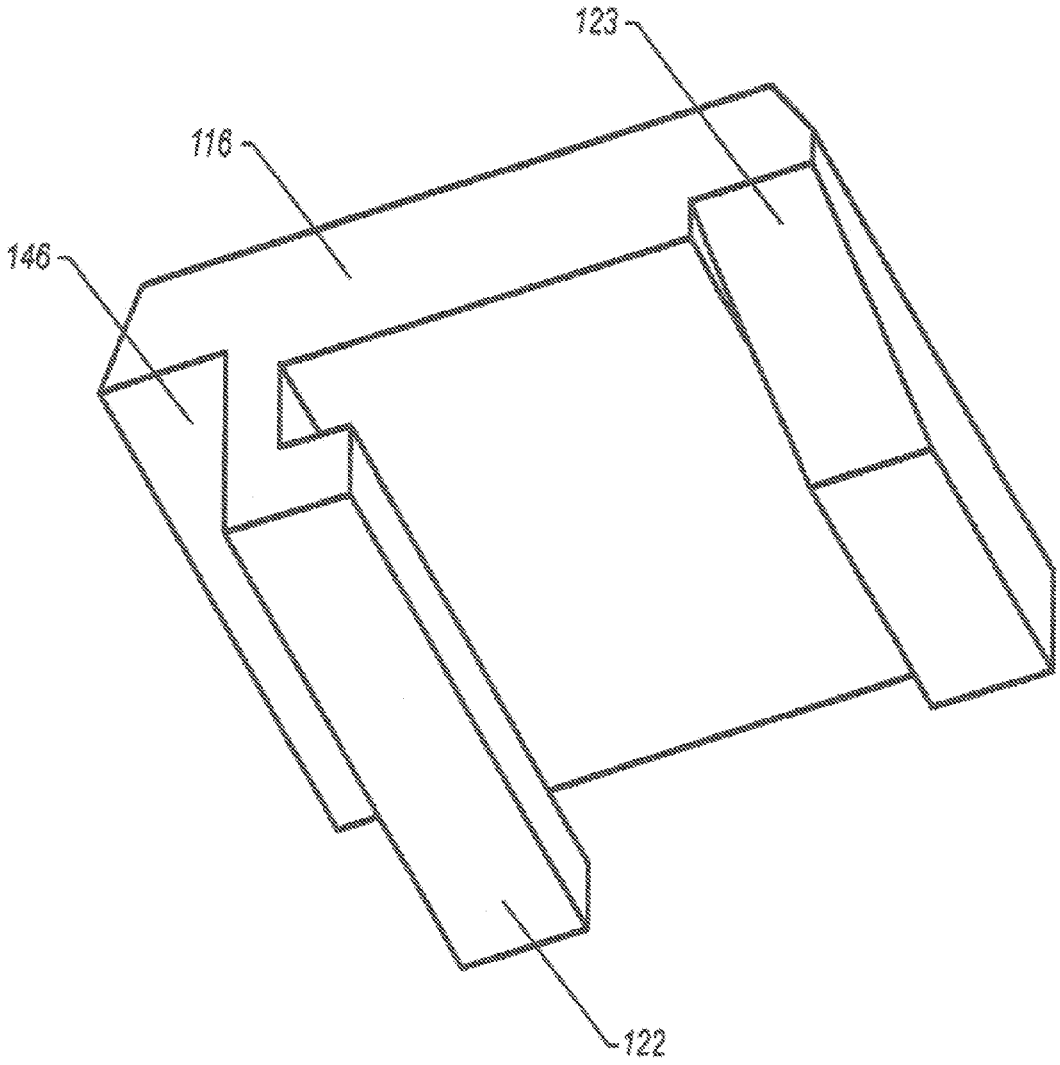
FIG. 18 is a bottom perspective view of the seal arm shown in FIG. 17.

A top perspective view and bottom perspective view of seal arm 116 are shown in FIGS. 17 and 18, respectively. A right-angle protrusion 122 extending downward from seal arm 116 forms a mechanism into which the flat flexible rectangular elastomer 118 (not shown in FIGS. 17 and 18) is inserted. The thickness of elastomer 118 is such that it can be compressibly and removeably inserted laterally into the notch 120 formed by right-angle protrusion 122.

Returning to FIG. 15, in a closed valve position where the seal arm 116 seals off the end of tube 74, an upward water pressure P1 is counteracted by a downward pressure P2 that is differentially greater than P1,so that diaphragm 60 is held against the upper end 36 of tube 24. In this closed valve condition, no water flows out of tube 24 and wheel 78 is not caused to rotate.

In FIG. 16 the open valve condition is shown. The seal arm is lifted allowing water to flow from hole 76 of tube 74 of cone 66. This allows diaphragm 60 to be forced upward toward concave lower surface of 70 of cone 66, and also enables water to flow upward through hole 62 of diaphragm 60. When diaphragm 60 is forced upward by pressure of water in tube 24, water is able to flow out of end 36 of tube 24 against diaphragm 60, which directs the water downward through diverter 48 (not shown in FIGS. 15 and 16) generally in the direction of the arrows shown in FIG. 16.

More specifically, in the open valve condition, water flows laterally through channels 56 of diverter 48 and strikes fins 87 of water wheel 78, thereby causing wheel 78 to rotate. The water released from tube 24 then flows downward and enters into the tank through holes 47 uniformly space around the circumference of lower body 10. This allows water to flow into the tank in the open valve condition. Thus, cone 66 and diaphragm 60 act as a control valve that enables water to flow from the inlet tube to the diverter when the valve is open and that disables water from flowing from the inlet tube when the valve is closed.

Figure 19:
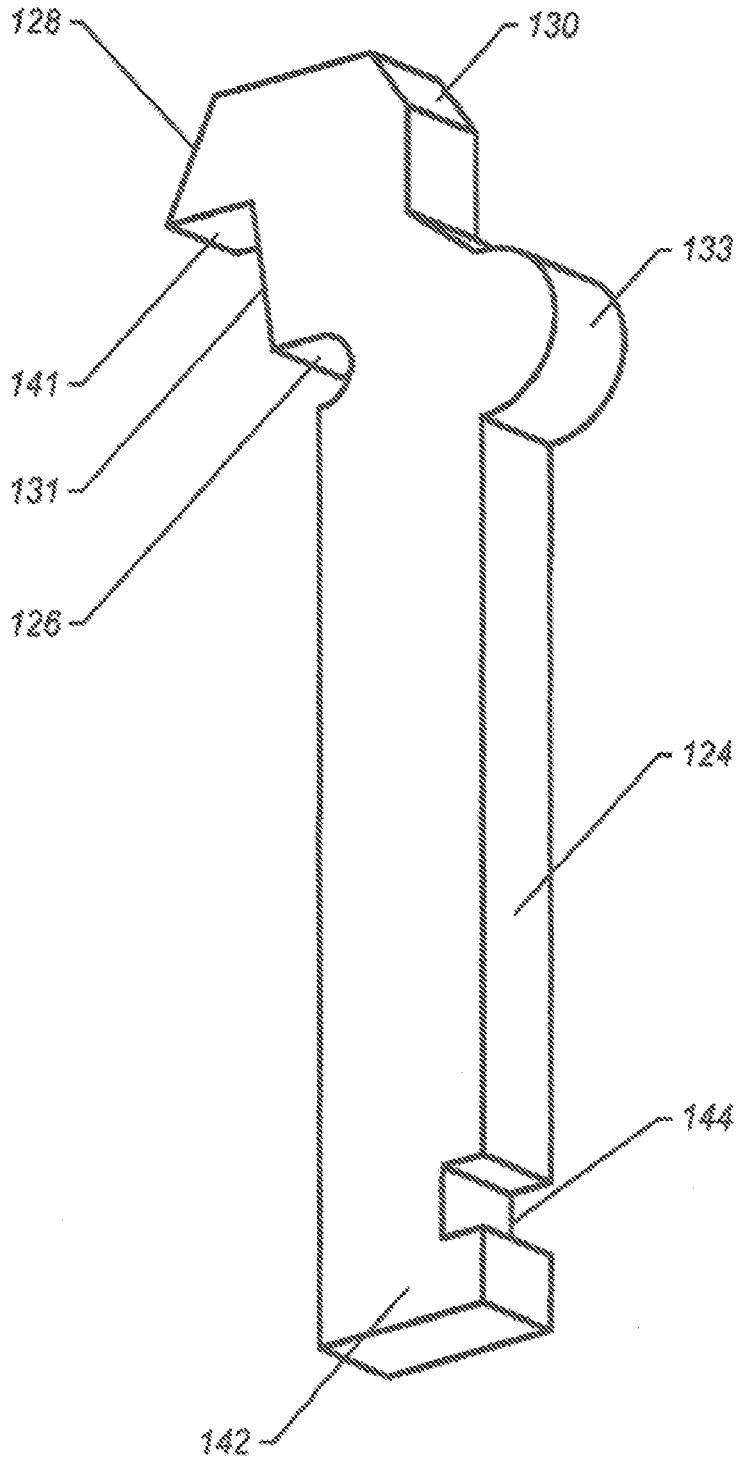
FIG. 19 is a perspective view of a pawl.

The lifting and lowering of seal arm 116, and consequently, the establishment of an open-valve or closed-valve position, is controlled by the position of a pawl 124. Pawl 124 is shown separately in FIG. 19. When positioned within a control housing, to be discussed below, pawl 124 pivots about a notch point 126 so that end 128 of pawl 124 may be placed in a downward or upward position.

When end 128 of pawl 124 is in the downward position, as depicted in FIG. 15, seal arm 116 is forced downward by a spring (not shown) to seal hole 76 of tube 74 of cone 66. When end 128 of pawl 124 is in the upward position, as depicted in FIG. 16, seal arm 116 is lifted upward by edge 130 of pawl 124, which forces upward against edge 123 of seal arm 116, to unseal hole 76 of tube 74 of cone 66.

Figure 20:
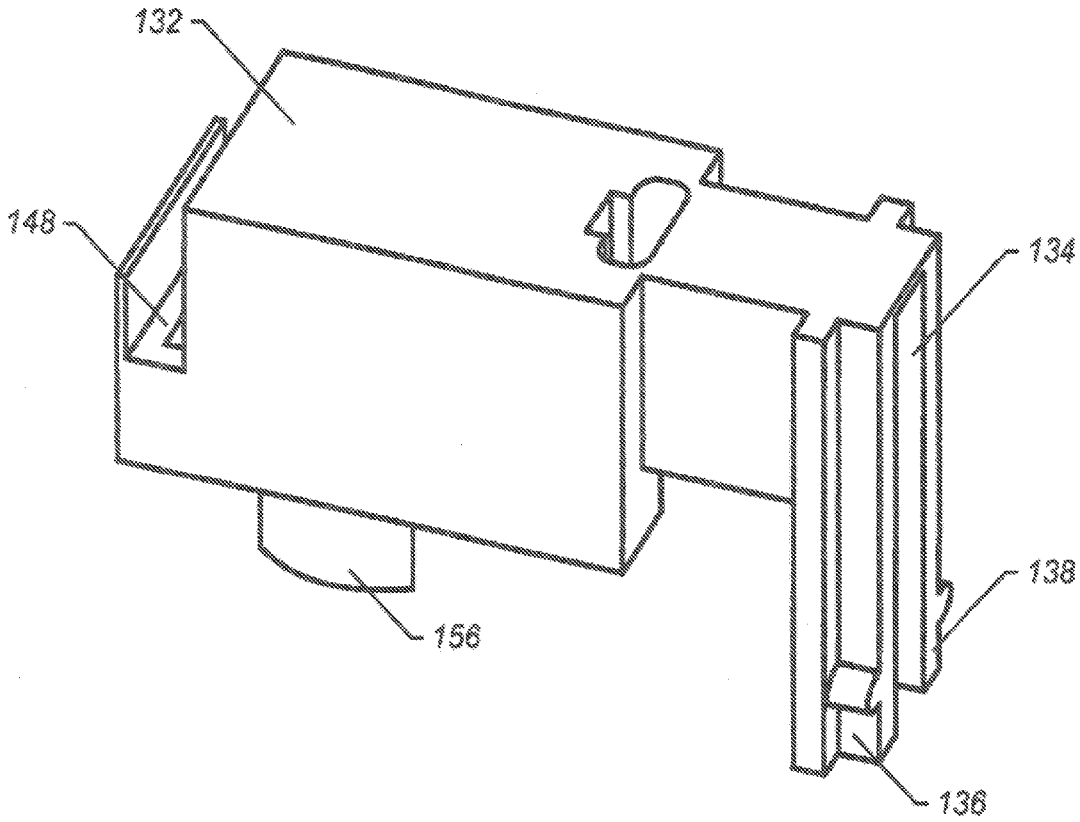
FIG. 20 is a top perspective view of a control housing.
Figure 21:
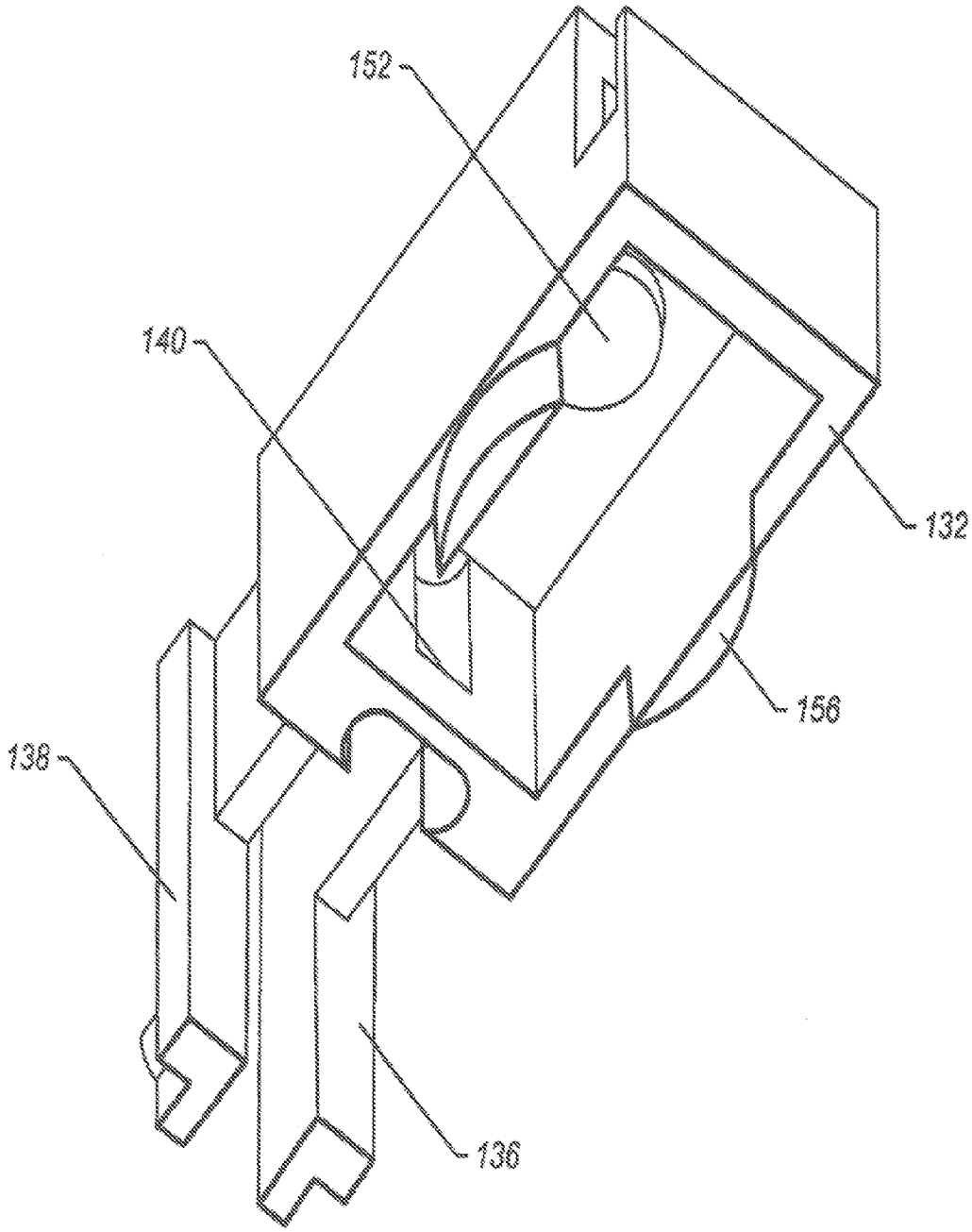
FIG. 21 is a bottom perspective view of the control housing shown in FIG. 20.

Shown in FIGS. 20 and 21 are a top perspective view and bottom perspective view, respectively, of a control housing 132 for housing seal arm 116 and pawl 124. At one end of control housing 132 is a protruding ridge structure 134 that cooperatively mates with the slot structure 40 (shown in FIGS. 3 and 4) formed in upper assembly housing 14. End 128 of pawl 124 removeably inserts between ridges 136 and 138 such that when placed in position therein edge 130 of pawl 124 faces upward, and notch 126 of pawl 124 rests on an edge 140 of control housing 132. When so positioned, pawl 124 is able to pivot about notch 126 to enable end 128 to move upward and downward to raise and lower seal arm 116.

Note that pawl 124 exhibits an upper protrusion 133 such that when pawl 124 is properly positioned within control housing 132 interference between upper protrusion 133 and the upper interior surface of control housing 132 prevents pawl 124 from being inadvertently pulled laterally out of housing 132 when housing 132 is positioned in slot 40.

The end 142 of pawl 124, opposite end 128, extends outward between ridges 136 and 136 of control housing 132, and consequently extends outward from assembly housing 14, such that a notch 144 in pawl 124 is exposed and enables attachment of a chain thereto. When that chain is pulled downward, thereby pulling down end 142 of pawl 124, pawl 124 pivots about notch point 126, thereby lifting end 128 of pawl 124.

Seal arm 116, and elastomer 118 affixed thereto, is also inserted into control housing 132, and is positioned such that an edge 146 of seal arm 116 rests upon an edge 148 of control housing 132, and such that a spring (not shown) is removably fixed at one end to cylindrical protrusion 150 extending upward from seal arm 116 and removably fixed at an opposite end to cylindrical protrusion 152 on the upper interior surface of control housing 132. Thus, seal arm 116 is positioned within control housing 132 above pawl 124 such that spring tension exerts a downward force on seal arm 116.

The assembly of the spring, pawl arm, seal arm and control housing is positioned with ridge structure 134 inserted into slot 40 such that a pair of curved semi-circular ridges 156 of control housing 132 insert interior to semi-circular ridges 112 of top gear 102. When the assembled control housing is so positioned, seal arm 116 and elastomer 118 are positioned above tube 74 of cone 66 and such that end 128 of pawl 124 lies in a gap 114 between semi-circular ridges 112. Unless and until end 142 of pawl 124 is pulled upward, end 128 will be held in the gap 114 by seal arm 116. This is the closed valve condition wherein water wheel 78 cannot turn and water cannot flow from tube 24.

However, when end 142 of pawl 124 is pulled downward, end 128 of pawl 124 lifts upward against spring tension to lift seal arm 116, placing the device in an open valve condition, thereby starting the flush cycle. Bottom surface 131 of pawl 124 is lifted above the top surface 115 of a semi-circular ridge 112 of top gear 102. This enables top gear 102 to turn in mechanical response to the rotation of wheel 78 caused by flow of water through diverter 48. As top gear 102 rotates, surface 131 rides atop surface 115 of a ridge 112 until the next gap 114 is reached, at which time, end 128 of pawl 124 drops into the gap. When pawl 124 drops into the gap, rotation of top gear 102 is forced to stop and simultaneously, seal arm 116 is forced by spring pressure downward to seal tube 74. This in turn causes diaphragm 60 to be forced downward, thereby sealing off tube 24. When tube 24 is again sealed off, no more water flows into the tank and the flush cycle is completed.

Thus, semi-circular ridges 112 with gaps 114 forms a cam that moves in response to the mechanical motion of the wheel and gear assembly caused by the flow of water from the diverter. The pawl acts as a cam engager that causes the control valve formed by the diaphragm and cone to close in response to a pre-determinable extent of motion of the cam. Combined, the cam and pawl implement a mechanical switch, responsive to the motion caused by the flow of water from the diverter that closes the control valve when a pre-determinable volume of water flows from the inlet tube.

The upper assembly housing 14 may be covered with a cover that removeably snaps into place to protect the meter assembly described above from contaminates. If maintenance or inspection of the meter assembly is desired, the cover can be removed, and some or all of the parts inserted within assembly housing 14 can be easily and quickly removed and reassembled or replaced.

Figure 22:
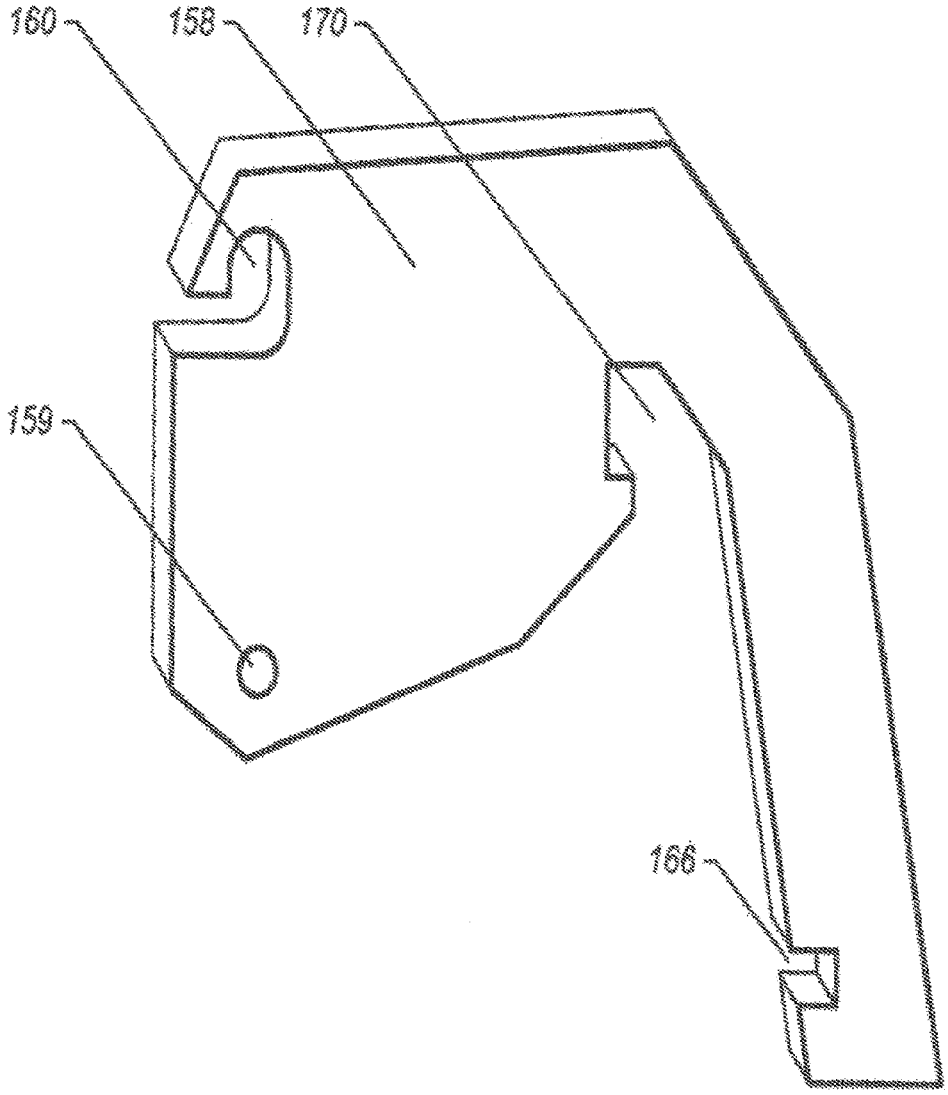
FIG. 22 is a perspective view of an upper actuator.

As noted above, the end 142 of pawl 124 extends outward from assembly housing 14, such that notch 144 is exposed and enables attachment of a chain thereto. That chain hangs downward and an opposite end of the chain is attached to an actuator mechanism as will now be described. Shown in FIG. 22 is a perspective view of an upper actuator 158. The chain connected at one end to notch 144 of pawl 124 is connected at the opposite end to a notch 160 of upper actuator 158. When so connected, a downward motion of notch 160 will pull the chain downward, thereby pulling downward end 142 of pawl 124, which in turn lifts end 128 of pawl 124 out of a gap 114, in order to begin a metered flush cycle.

Figure 23:
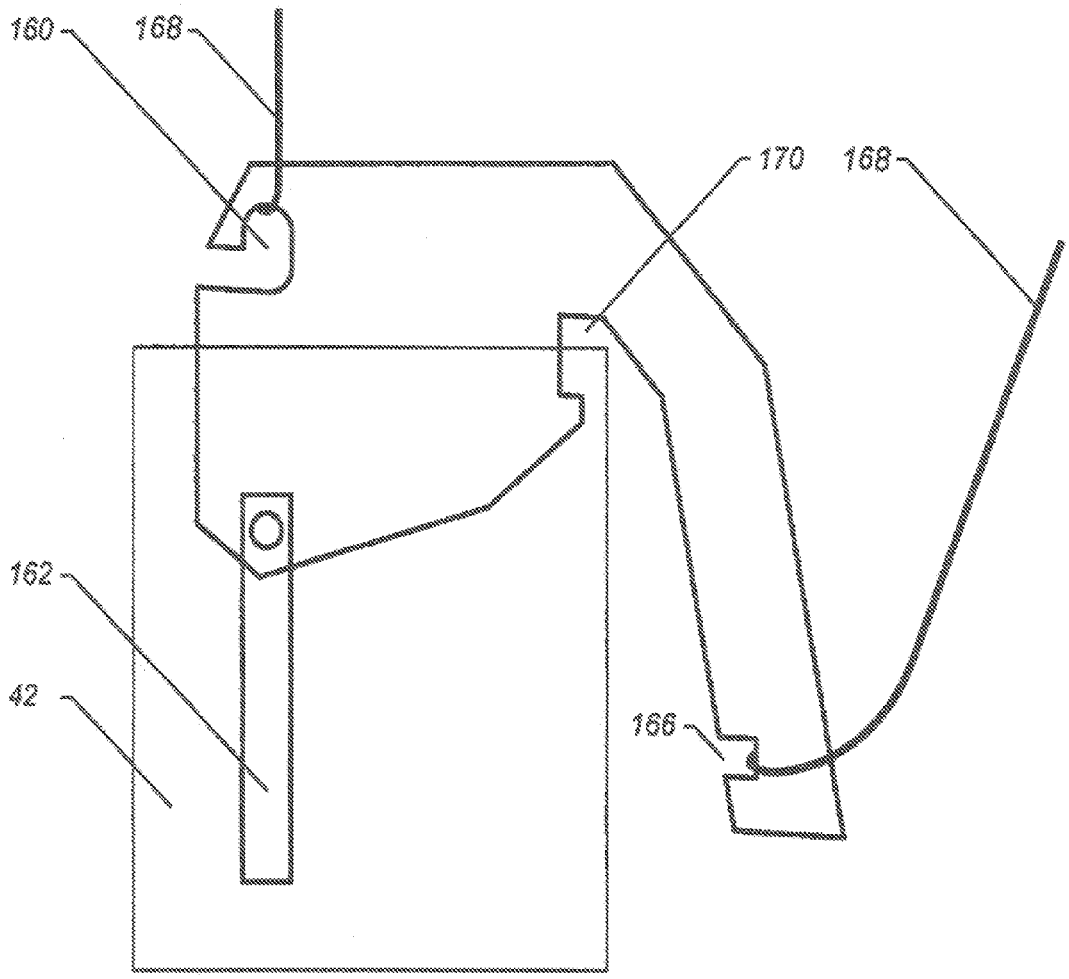
FIGS. 23, 24, and 25 illustrate operation of an actuator assembly.
Figure 24:
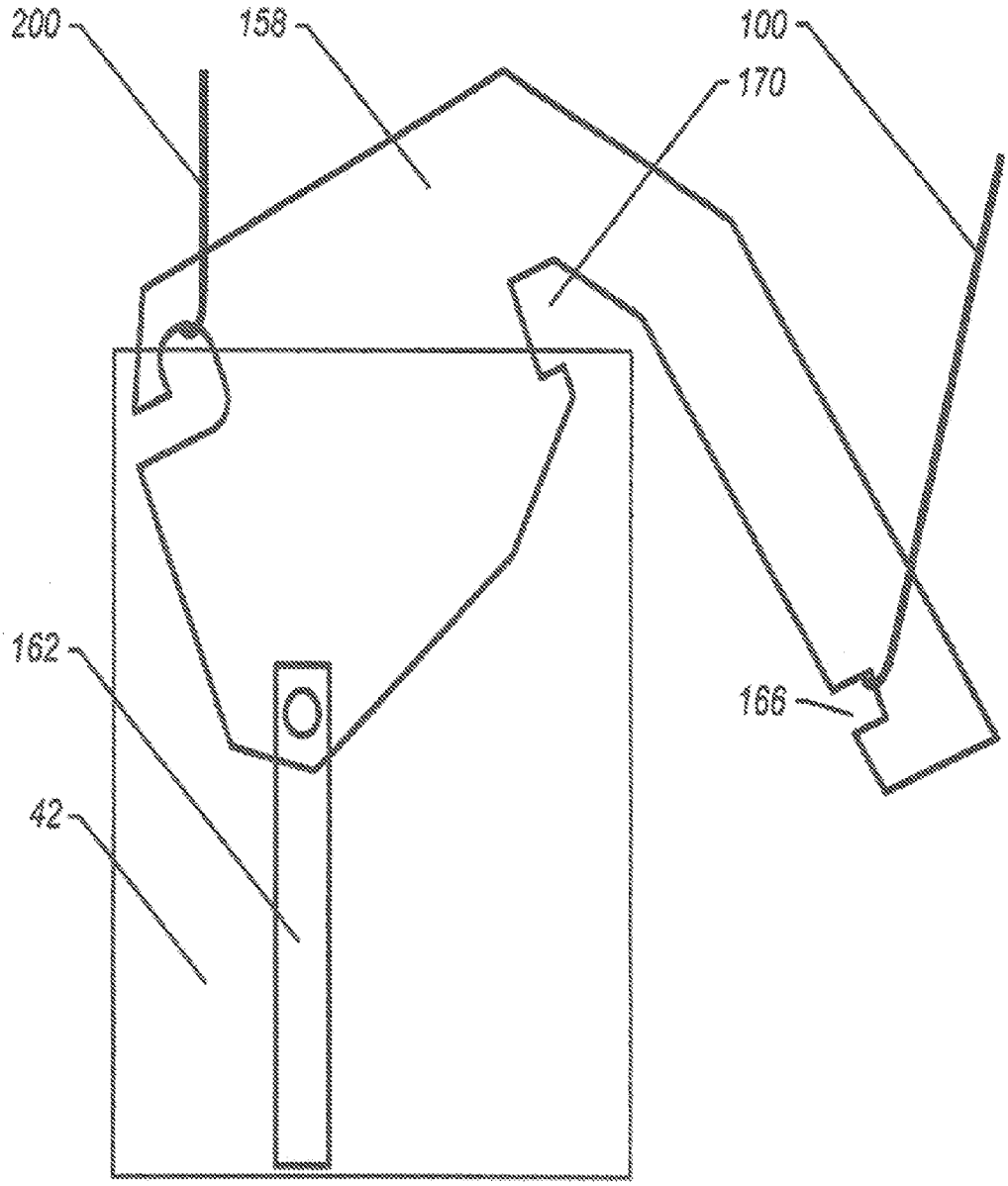
Figure 25:
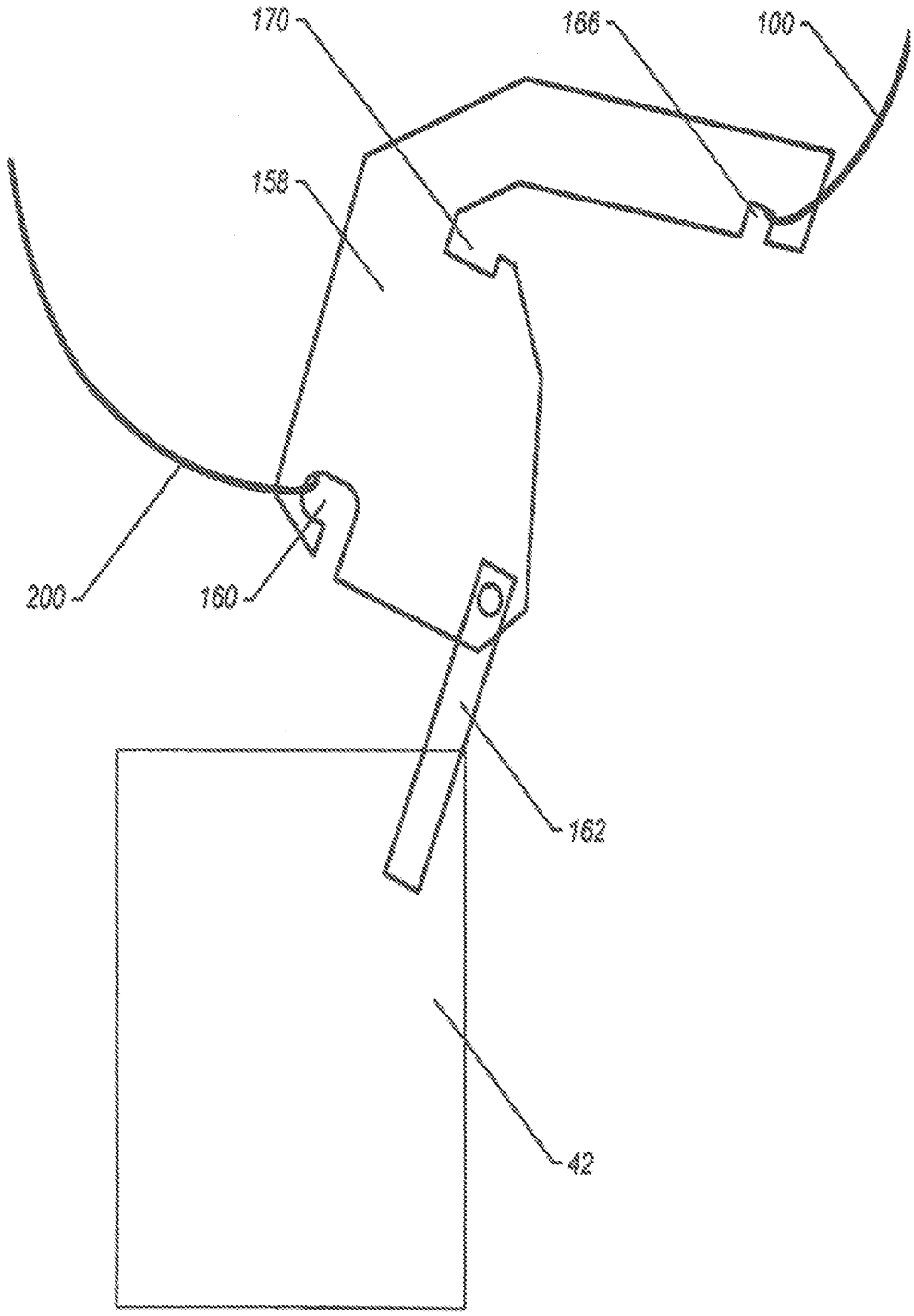
Figure 26:
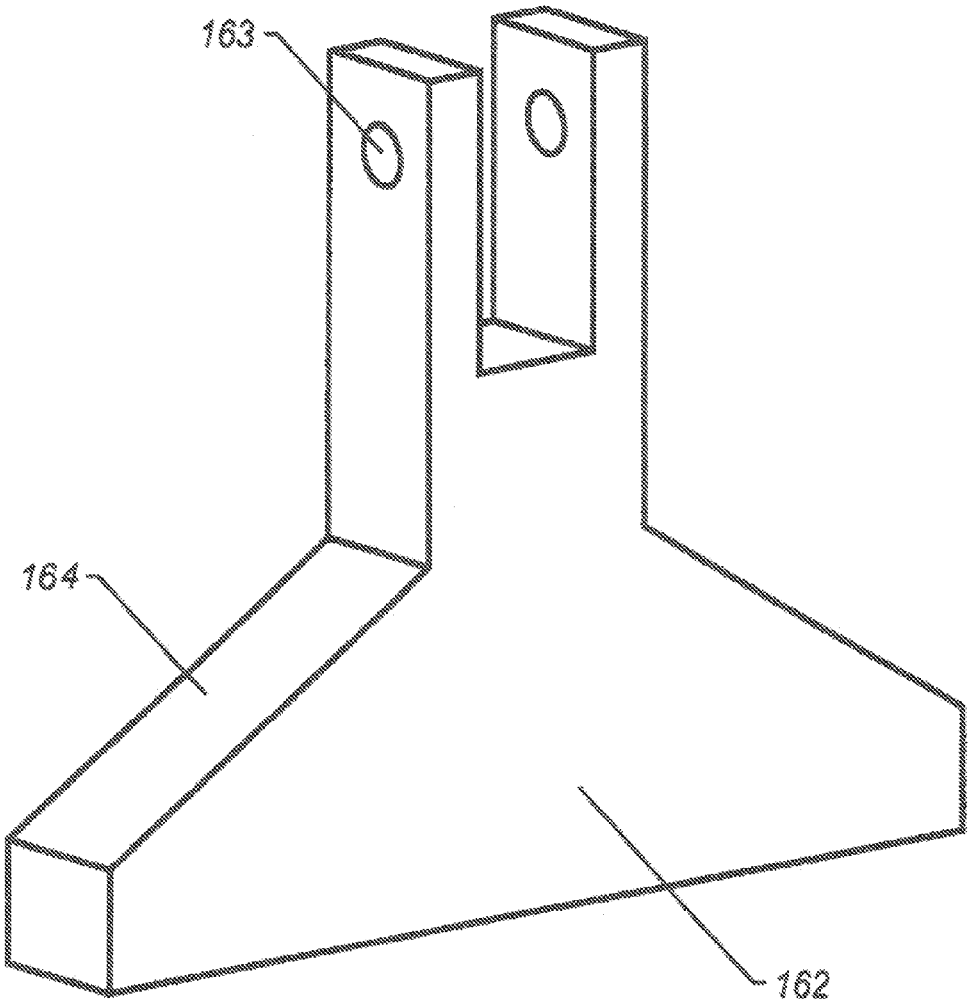
FIG. 26 is a perspective view of a lower actuator.

An illustration of the operation of the actuator mechanism of the present invention is shown in FIGS. 23, 24 and 25. In FIG. 23 upper actuator 158 is shown in its quiescent position within actuator housing 42. Attached to upper actuator 158 is lower actuator 162 shown in perspective view in FIG. 26. Upper and lower actuators 158 and 162 are connected to each other by a pin (not shown) inserted through holes 163 of lower actuator 162 and a hole 159 in upper actuator 158. Lower actuator 162 exhibits flared wings 164 that prevent the assembled actuator mechanism from being pulled out and away from actuator housing 42.

FIG. 23 shows a chain 168 in a slack condition with one end connected to a notch 166 of upper actuator 158. Chain 168 rises upward and is connected at the other end to the conventional flush arm (not shown) of a toilet. Connected to notch 160 is a second chain 168 that is connected at its other end to notch 144 of pawl 124, which extends out of assembly housing 14 approximately directly above notch 160.

Referring to FIG. 24, when the toilet is flushed, the flush arm is raised at the far end to which chain 168 is connected. This lifts the flapper which is connected to the flush arm typically by a chain, thereby allowing water to flow from the tank into the bowl of the toilet. Raising the flush arm also simultaneously pulls the slack from chain 168 exerting an upward force on upper actuator 158 at notch 166. In response, upper actuator 158 pivots about notch 170, such that notch 160 is forced downward. This causes chain 168 to exert a downward force on end 142 of pawl 124. This starts the metered flush cycle as described above. When the flush arm is released and returns to its quiescent position, chain 168 becomes slack, and upper actuator 158 returns to its quiescent position, as shown in FIG. 23.

In the event the flush arm pulls up to far, upper actuator may be pulled out of actuator housing 42 as shown in FIG. 25. In this event interference of wings 164 of lower actuator 162 with the upper edges of actuator housing 42 prevents the actuator mechanism from being removed from actuator housing 42. Therefore, the actuator is restrained by the actuator housing to be retained partially therein. The action of the actuator also ensures that chain 168 will be slack to allow end 142 of 124 to pivot back upward. When the flush arm is released, the actuator mechanism then returns to its quiescent state as shown in FIG. 23.

Thus the actuator is linked to the flush arm and to the mechanical switch formed by the pawl and cam to open the control valve formed by the cone and diaphragm in response to motion of the flush arm to allow a pre-determinable volume of water to discharge into the tank. Note that once the toilet is flushed causing the actuator assembly to exert downward force on end 142 of pawl 124, the metered flush cycle assembly in assembly housing 14 operates independently of the position of the actuator and flush arm and independently of the position of the flapper.

Thus, for example if the flapper leaks or does not close, the tank will not fill, but water will nevertheless cease to flow into the tank once the flush cycle assembly completes its operation. That is, once end 128 of pawl 124 falls back into a gap 114 between semi-circular ridges 112, the flush cycle ends and no more water will flow from tube 24 into the tank (or into the overflow tube), regardless of the position of the flapper, the actuator or the flush arm.

Note also that the pre-determinable volume of water that flows out from holes 47 into the tank during the metered flush cycle of the present invention is independent of the water pressure received from the water line. Higher pressure merely causes the flush cycle to complete more rapidly, as higher pressure causes water wheel 78 to rotate with higher angular velocity, thereby causing more rapid rotation of top gear 102. Nevertheless, the cycle still terminates when the pawl end drops into the gap, as described above.

The duration of the flush cycle is desirably limited to about a minute or less. This can be controlled by the gearing ratio in the gearing assembly as would be recognized by one of ordinary skill in the art. Also, the pre-determinable volume of water that flows into the tank during a flush cycle can also be controlled by adjusting the position and number of gaps 114 and semi-circular ridges 112 in top gear 102. This enables the invention to easily be adapted to tanks of different volumetric capacities. Also, as mentioned above, tanks of different heights can be accommodated by adjusting the height of the assembly as described in conjunction with FIG. 1.

The present invention can be implemented by using low-cost lightweight components made of PVC or other materials now known in the art or to be developed. Because the invention automatically disables the flow of additional water from the water line once a pre-determined volume of water has flown there from, water will not continue to flow and be wasted or leaked because of, for example, a leaking flapper, cracked toilet tank or other defect. Also, a preferred embodiment of the invention provides a much less noisy flush since the metering assembly and inlet tube are interior to and insulated by the shell of the upper body. Further, because the height of the inlet tube and metering assembly can be adjusted to ensure that water in the inlet tube is conducted to a level above the water line of the tank, the present invention conforms to the Universal Plumbing Code and other standards for the prevention of siphoning.

Thus, although the present invention and its advantages have been described in detail, it should be understood that various changes, substitutions and alterations can be made herein without departing from the spirit and scope of the invention as defined by the appended claims. The invention achieves multiple objectives and because the invention can be used in different applications for different purposes, not every embodiment falling within the scope of the attached claims will achieve every objective.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

I claim:

1. A metered water control system for flush toilet tanks, comprising:

an inlet tube that receives water from a water line and conducts water into the interior of the tank to a diverter;

a diverter that channels the flow of water received from the inlet tube to cause mechanical motion of a wheel geared to a cam in response to the channeled flow;

a control valve, responsive to a mechanical switch, that enables and disables the flow of water from the inlet tube to the diverter; and a mechanical switch, responsive to the mechanical motion caused by the flow of water from the diverter, which closes the control valve automatically when a pre-determinable volume of water flows through the diverter, wherein the inlet tube passes through the interior of the discharge tube to conduct water received form the water line to a level above the water line of the tank.

2. The system of claim 1, wherein said mechanical switch further comprises:

a cam that moves in response to mechanical motion caused by the flow of water from the diverter;

a cam engager linked to an actuator that causes the control valve to open in response to motion of the actuator, and that causes the control valve to close in response to a pre-determinable extent of motion of the cam;

a discharge tube that receives water from the diverter to discharge the water into the tank; and an actuator linked to a flush arm of the toilet and linked to the mechanical switch to cause the switch to open the control valve in response to motion of the flush arm to allow the pre-determined volume of water to flow through the diverter into the discharge tube.

3. The system of claim 1, wherein the cam engager:

causes the control valve to open by unsealing an outlet of the control valve to cause water pressure to force water to flow from the inlet tube through the diverter; and causes the control valve to close by sealing the outlet to create pressure that prevents water from flowing from the inlet tube through the diverter.

4. The system of claim 1, wherein the mechanical switch closes the control valve independently from the actuator.

5. A metered water control system for flush toilet tanks, comprising:

an inlet tube that receives water from a water line and conducts water into the interior of the tank to a diverter;

a diverter that channels the flow of water received from the inlet tube to cause mechanical motion responsive to the channeled flow;

a control valve, responsive to a mechanical switch that opens and closes access of the water from the inlet tube to the diverter;

a mechanical switch, responsive to the mechanical motion caused by the flow of water from the diverter, that closes the control valve automatically when a pre-determinable volume of water flows through the diverter;

a discharge tube that receives water from the diverter to discharge the water into the tank; and an actuator linked to a flush arm of the toilet and linked to the mechanical switch to cause the switch to open the control valve in response to motion of the flush arm to allow the pre-determined volume of water to flow through the diverter into the discharge tube.

wherein the inlet tube passes through the interior of the discharge tube.

6. The system of claim 5, wherein the mechanical switch further comprises:

a cam that moves in response to mechanical motion caused by the flow of water from the diverter; and a cam engager linked to the actuator that causes the control valve to open in response to motion of the actuator, and that causes the control valve to close in response to a pre-determinable extent of motion of the cam.

7. The system of claim 6, wherein the cam engager:

causes the control valve to open by unsealing an outlet of the control valve to cause water pressure to force water to flow from the inlet tube through the diverter; and causes the control valve to close by sealing the outlet to create pressure that prevents water from flowing from the inlet tube through the diverter.

8. The system of claim 7, wherein the cam engager further engages a seal arm to seal and unseal the outlet.

9. The system of claim 5, wherein the actuator is positioned partially within an actuator housing that restrains the actuator to be partially retained therein.

10. The system of claim 5, wherein the mechanical switch closes the control valve independently from the actuator.

11. The system of claim 5, wherein the inlet tube conducts the water from the water line to a level above the water line of the tank.

* * * * *